US008721221B2

(12) United States Patent
Cavenagh et al.

(10) Patent No.: US 8,721,221 B2
(45) Date of Patent: May 13, 2014

(54) SYSTEM FOR PROVIDING FLOOD PROTECTION AND METHOD OF IMPLEMENTING SAME

(75) Inventors: Edward John Cavenagh, Winnipeg (CA); Gregg Martin, Winnipeg (CA); Selamawit Tedesse Desta, Winnipeg (CA)

(73) Assignee: Premark Packaging LLC, Glenview, IL (US)

( * ) Notice: Subject to any disclaimer, the term of this patent is extended or adjusted under 35 U.S.C. 154(b) by 89 days.

(21) Appl. No.: 13/310,494

(22) Filed: Dec. 2, 2011

(65) Prior Publication Data

US 2012/0207406 A1 Aug. 16, 2012

Related U.S. Application Data

(60) Provisional application No. 61/443,717, filed on Feb. 16, 2011.

(51) Int. Cl.
*E02B 3/10* (2006.01)
*E02B 7/00* (2006.01)

(52) U.S. Cl.
USPC ..... 405/114; 405/16; 405/17; 405/18; 405/111; 405/116

(58) Field of Classification Search
USPC ..... 405/15, 16, 17, 18, 107, 110, 111, 114, 405/115, 116
See application file for complete search history.

(56) References Cited

U.S. PATENT DOCUMENTS 269,625 A 12/1882 Blake
338,892 A 3/1886 Walker
1,971,642 A 8/1934 Champlin
3,213,628 A * 10/1965 Serota ..... 405/111
3,222,019 A 12/1965 Weisberg (Continued)

FOREIGN PATENT DOCUMENTS

CN 201469991 5/2010
DE 39 28 054 2/1991

(Continued)

OTHER PUBLICATIONS

TrapBag® Flood Barriers; http://trapbag.com/flood-uses/flood-barriers; Fort Myers, FL; printed on Mar. 16, 2012; 1 page.

(Continued)

*Primary Examiner* — Frederick L Lagman
(74) *Attorney, Agent, or Firm* — Whyte Hirschboeck Dudek S.C.

(57) ABSTRACT

A flood protection bag system includes a troughlike structure having longitudinally-extending sidewalls and a bottom wall connected therebetween, along with one or more internal walls, the internal walls serving to divide the troughlike structure into a plurality of bag chambers. The longitudinally-extending sidewalls are continuous and seamless between the ends of the troughlike structure, and the bag system can be made of a plastic such as polypropylene. In one embodiment, the bag system may be implemented in conjunction with other such bag system(s). Also, in one embodiment, a frame structure is employed to support the bag chamber(s) during filling thereof with sand or other filling material, in a manner whereby tension is applied to each of the corners of the given bag chamber being filled. Further, in one embodiment, the bag chambers are covered by way of a bag top that is openable or removable relative to the bag system.

25 Claims, 14 Drawing Sheets

(56) References Cited

U.S. PATENT DOCUMENTS

| | | | | |
|---|---|---|---|---|
| 3,633,859 | A | 1/1972 | Vosbikian | |
| 3,671,709 | A | 6/1972 | Gridge | |
| 3,791,908 | A | 2/1974 | Gridge | |
| 3,827,471 | A | 8/1974 | Gregory et al. | |
| 3,893,595 | A | 7/1975 | Khanna et al. | |
| 4,027,987 | A | 6/1977 | Berkowitz | |
| 4,236,559 | A | 12/1980 | Archbold | |
| 4,267,996 | A | 5/1981 | Turcott | |
| 4,390,051 | A | 6/1983 | Cuthbertson | |
| 4,594,206 | A * | 6/1986 | Grafton | 405/29 |
| 4,610,028 | A * | 9/1986 | Nattrass | 383/7 |
| 4,646,357 | A | 2/1987 | Nattrass | |
| 4,807,299 | A * | 2/1989 | Nattrass et al. | 383/109 |
| 5,025,925 | A | 6/1991 | Wiklund | |
| 5,040,919 | A * | 8/1991 | Hendrix | 405/115 |
| 5,069,596 | A | 12/1991 | Mueller et al. | |
| 5,143,779 | A | 9/1992 | Newkirk et al. | |
| 5,198,057 | A | 3/1993 | Newkirk et al. | |
| 5,320,455 | A | 6/1994 | Mattox | |
| 5,333,970 | A | 8/1994 | Heselden | |
| 5,340,218 | A * | 8/1994 | Cuthbertson | 383/67 |
| 5,472,297 | A | 12/1995 | Heselden | |
| 5,638,853 | A | 6/1997 | Tsai | |
| 5,685,450 | A * | 11/1997 | Uda | 220/495.01 |
| 5,687,881 | A | 11/1997 | Rouse et al. | |
| D393,322 | S | 4/1998 | Suttles | |
| 5,975,759 | A | 11/1999 | Renaud | |
| 6,012,872 | A | 1/2000 | Perry et al. | |
| 6,390,154 | B1 | 5/2002 | Hall | |
| 6,450,666 | B1 | 9/2002 | Briscoe et al. | |
| 6,467,955 | B1 | 10/2002 | Kim | |
| 6,637,474 | B2 | 10/2003 | Hall | |
| 7,140,516 | B2 | 11/2006 | Bothor et al. | |
| 7,156,555 | B2 | 1/2007 | Richardson, Jr. et al. | |
| 7,431,534 | B2 | 10/2008 | Harbeck | |
| 7,500,786 | B2 | 3/2009 | Richardson, Jr. et al. | |
| 7,708,501 | B2 | 5/2010 | Heselden | |
| 7,789,592 | B2 | 9/2010 | Heselden | |
| 7,854,574 | B2 | 12/2010 | Heselden | |
| 7,866,923 | B2 | 1/2011 | Knudson et al. | |
| 7,883,297 | B2 | 2/2011 | Heselden | |
| 7,891,913 | B2 | 2/2011 | Heselden | |
| 7,896,583 | B2 | 3/2011 | Heselden | |
| 7,922,421 | B2 * | 4/2011 | McGillick et al. | 405/16 |
| 8,173,241 | B2 | 5/2012 | Halahmi et al. | |
| 8,235,631 | B2 * | 8/2012 | Adams et al. | 405/107 |
| 2005/0284080 | A1 | 12/2005 | Gallego et al. | |
| 2006/0275084 | A1 | 12/2006 | Harbeck | |
| 2007/0127852 | A1 | 6/2007 | Town et al. | |
| 2007/0140598 | A1 * | 6/2007 | McGillick et al. | 383/22 |
| 2008/0017020 | A1 | 1/2008 | Casper | |
| 2008/0202073 | A1 | 8/2008 | Kim | |
| 2008/0219772 | A1 | 9/2008 | Mcdonald | |
| 2008/0248236 | A1 | 10/2008 | Erez | |
| 2009/0142136 | A1 | 6/2009 | Thompson | |
| 2009/0235507 | A1 | 9/2009 | Cashin et al. | |
| 2009/0235813 | A1 | 9/2009 | Cashin et al. | |
| 2009/0235814 | A1 | 9/2009 | Cashin et al. | |
| 2009/0324346 | A1 | 12/2009 | Milton et al. | |
| 2010/0008726 | A1 | 1/2010 | Heselden | |
| 2010/0080659 | A1 | 4/2010 | Halahmi et al. | |
| 2010/0143049 | A1 | 6/2010 | Heselden | |
| 2010/0150667 | A1 | 6/2010 | Phelps | |
| 2010/0186642 | A1 | 7/2010 | Christman et al. | |
| 2010/0193512 | A1 | 8/2010 | Heselden | |
| 2010/0254795 | A1 | 10/2010 | Halahmi et al. | |
| 2010/0272378 | A1 | 10/2010 | Mueller | |
| 2011/0033236 | A1 | 2/2011 | Heselden | |
| 2011/0033654 | A1 | 2/2011 | Walmsley et al. | |
| 2011/0103900 | A1 * | 5/2011 | Adams et al. | 405/284 |
| 2011/0318104 | A1 * | 12/2011 | Peterson et al. | 405/16 |
| 2012/0193354 | A1 | 8/2012 | Cavenagh et al. | |
| 2012/0195687 | A1 * | 8/2012 | Beard et al. | 405/114 |
| 2013/0094905 | A1 * | 4/2013 | Schnaars et al. | 405/114 |

FOREIGN PATENT DOCUMENTS

| | | | | |
|---|---|---|---|---|
| DE | 10239249 | A1 * | 3/2004 | E02B 3/10 |
| DE | 102008026647 | | 4/2010 | |
| EP | 0 030 442 | | 6/1981 | |
| EP | 0735198 | | 10/1996 | |
| GB | 2 403 200 | | 12/2004 | |
| JP | 59038407 | | 3/1984 | |
| JP | 62129423 | | 6/1987 | |
| JP | 2001-106291 | | 4/2001 | |
| JP | 2001090039 | | 4/2001 | |
| JP | 2003074061 | | 3/2003 | |
| JP | 2005016112 | | 1/2005 | |
| JP | 2007-91315 | | 4/2007 | |
| JP | 2008057285 | | 3/2008 | |
| JP | 2008150879 | | 7/2008 | |
| WO | 95/01294 | | 1/1995 | |
| WO | 2006/032073 | | 3/2006 | |
| WO | 2010/148497 | | 12/2010 | |

OTHER PUBLICATIONS

What Are TrapBag® Barriers?; http://trapbag.com/what-it-is; Fort Myers, FL; printed on Oct. 25, 2012; 1 page.

TrapBag® Uses; http://www.floodandsandbags.com/flooding/trapbag_uses.htm; Sentinel Barriers; available at least as early as Feb. 28, 2011, printed on Mar. 4, 2011; 208 pages.

Attachment A-1, Documentation Regarding The Trapbag Delivery System, available from Sentinel Barriers LLC; available at least as early as Feb. 28, 2011; 14 pages.

PowerPoint presentation slides concerning Syntex "Flood Protection Products" dated Feb. 8, 2011; admitted to be prior art existing as early as Feb. 15, 2010; 9 pages.

PowerPoint presentation slides concerning "Competitive Products" dated Jan. 28, 2011; 8 pages.

Invitation to Pay Additional Fees and Communication Relating to the Results of the Partial International Search; International Application No. PCT/US2012/025179; Jun. 4, 2012; 7 pages.

International Search Report and Written Opinion of the International Searching Authority; International Application No. PCT/US2012/025179; Jul. 27, 2012; 23 pages.

International Application No. PCT/US2011/059578, International Search Report and Written Opinion; mailed on Feb. 20, 2012 (15 pgs.).

Bagster—Dumpster in a Bag; webarchive.org/web/20070521061017/hllp:l/www.thebagster.com; © BAGSTER, LLC 2007; 1 page.

* cited by examiner

SYSTEM FOR PROVIDING FLOOD PROTECTION AND METHOD OF IMPLEMENTING SAME

CROSS-REFERENCE TO RELATED APPLICATIONS

This application claims the benefit of U.S. provisional patent application No. 61/443,717, which was filed on Feb. 16, 2011 and entitled "System for Providing Flood Protection and Method of Implementing Same", and which is hereby incorporated by reference herein.

STATEMENT REGARDING FEDERALLY SPONSORED RESEARCH OR DEVELOPMENT

FIELD OF THE INVENTION

The present disclosure relates to systems for blocking the movement of, or otherwise providing protection against, moving or standing water (or possibly other liquids) as can occur during floods or other circumstances (and/or even providing other types of protection), as well as methods of assembling, using, and otherwise implementing such systems and, more particularly, to such systems and methods that involve the establishment or use of wall-like structure(s).

BACKGROUND

The prairie provinces of Canada and the central states of the United States have experienced several threats of floods during the last 20 years. Specific to Manitoba, Canada, there are currently forecasts of a major flood for the Spring of 2011. Indeed, due to a wet Summer/Fall of 2010 combined with above average amounts of snow during the 2010/11, there is now a forecast for above average run off for areas south of the $56^{th}$ parallel, and areas potentially affected by flooding will include not only the city of Winnipeg and rural areas in Manitoba but also areas close to the Assiniboine River. Even with average weather during the Spring of 2011, communities in this region will likely be hit with floods similar to the flooding that occurred in 2009. Further, there is a currently estimated to be a 10% chance of unfavorable weather prior to Spring 2011, which could lead to a flood in Winnipeg comparable to that of 1997, which has been referred to as "the Flood of the Century."

Given the damage caused by floodwaters historically, and the ongoing prospect of flooding in the future, people have developed various systems and methods for attempting to prevent floodwaters from causing excessive damage by attempting to block (or divert) the floodwaters from proceeding unimpeded into areas that would otherwise suffer great damage if exposed to those floodwaters. One conventional type of system in this respect involves the providing of numerous bags or bag-like structures into which sand or other filling material is deposited, and positioning numerous such bags or bag-like structures so as to establish one or more wall(s) that block the floodwaters from moving from area(s) where flooding is of less concern (or where in any event flooding cannot be effectively precluded) into area(s) with respect to which protection is desired. Yet such conventional systems involving bags (or bag-like structures) are limited in a variety of respects.

More particularly, if pre-filled bags (or bag-like structures) are used, such pre-filling can be expensive and the moving of such pre-filled bags can be time-consuming and labor-intensive and/or energy intensive. Practically speaking, pre-filling of bags also limits the size and weight of the pre-filled bags that can be utilized, since the difficulty and costs of moving such pre-filled bags goes up with the bag size. Conventional pre-filled bags, for example, can take on weights of 4000 pounds. Yet limiting bag size/weight in this manner can be undesirable. In particular, in some flooding circumstances (e.g., where the floodwaters are severe and the potential pressures upon a flood barrier are large) it can be desirable that the bags (or bag-like structures) have a larger size and/or weight so as to better withstand the floodwaters.

Alternatively, while certain systems have been developed which allow for the on-site filling of bags (or bag-like structures), at locations where sand or other filling material is available for the filling of such bags, such systems themselves can suffer from disadvantages as well. In some such systems, while individual sandbags can be filled with sand, the filling process of each individual bag is inefficient (e.g., during filling of a bag with sand, some sand will "miss" the bag entrance and be spilled over the sides of the bag). Also, in some such systems, even assuming that multiple individual sandbags are filled, the manner in which those sandbags are filled may result in sandbags that are not ideally suited for forming a wall. In particular, the individual sandbags may not be sufficiently regular or consistent in shape such that the sandbags, when placed together, form a wall that is sufficiently leak-proof.

Notwithstanding the disadvantages associated with conventional systems and methods, these systems have continued to be used frequently. Indeed, many of the properties that will likely require protection in the city of Winnipeg as well as in rural municipalities in Manitoba in 2011 (most of which sit between the primary dikes, or roads, city rivers and creeks) were sandbagged in the 1997 and 2009 floods. Nevertheless, there clearly is a need for improved systems and methods for flood protection, as the city of Winnipeg alone is planning to raise 15 kilometers of primary dikes in the coming weeks to protect the city from rising waters. Indeed, flood personnel from both the city of Winnipeg and the province of Manitoba are urgently searching for flood protection products that are one or more of stable, resistant to the force of rising waters, leakproof (or at least substantially leakproof), easy to set up, and easy to remove.

Given the above, it would be advantageous if new or improved systems or methods for providing flood protection could be developed that addressed one or more of the above-described issues and helped address the ongoing and, at this moment, imminent need for enhanced flood protection.

SUMMARY

Various embodiments of the present disclosure provide a flood protection system that includes a flood protection bag having a series of bag chambers positioned adjacent to one another and formed within an outer wall. The outer wall includes a bottom (floor) wall and two side walls that each run the length of the series of bag chambers. Different bag chambers are formed within the outer wall by virtue of a series of additional interior walls that each extend between the two side walls as well as down to the bottom wall of the outer wall, and that divide/separate neighboring bag chambers from one another. In one embodiment, the outer wall is constructed of polypropylene; however, it should be appreciated that other suitable materials may be used, such as robust but bendable, flexible, collapsible plastic materials or other materials that are more rigid.

The outer corners of each of the bag chambers are configured to be supported upward by a filling frame support during filling. For example, each bag chamber may include four corners, each of which is configured to be supported by a filling frame support during filling. In this manner, filling of each bag chamber proceeds in a manner that ultimately, upon completion, results in the respective bag chamber being filled in a regular, consistent manner that enables ultimate overall flood protection bag to take on a straight, consistent shape that is more stable and thereby provides for enhanced flood protection. It should be appreciated that different types of filling frame supports may be utilized for different filling operations. The type of filling frame support selected for a particular filling operation may be based on the application or circumstances including, for example, the strength of the barrier that is desired and the surface upon which the barrier is to be situated. For example, a filling frame support made of PVC pipe may be employed for light duty tilling operations, while a filling frame support made of steel tubing may be utilized for medium or heavy duty filling operations. Although certain filling frame supports are disclosed in detail herein, the present disclosure is also intended to encompass a variety of other embodiments of filling frame supports or other support mechanisms or structures that enable or facilitate filling of flood protection bag(s) such as those disclosed or encompassed herein. Also, the present disclosure is intended to encompass not only a variety of flood protection bag(s) and filling frame supports (or other support mechanisms or structures), but also use of a variety of devices that perform the filling of such bag(s) supported by such filling frame supports (or other support mechanism or structures), by lifting, depositing, or otherwise moving any of a variety of types of materials.

This configuration results in a flood protection bag having a plurality of bag chambers, which can be filled with relatively little spillage of sand (or other filling material) since most sand spilling out of a given bag chamber will end up in one of its neighboring bag chambers. Additionally, this configuration reduces leakage of floodwater between neighboring bags. Also, since the flood protection bag of the present disclosure has multiple chambers surrounded by a continuous, seamless outer trough formed by the side and bottom walls of the outer wall of the bag, the flood protection bag provides enhanced protection against leakage through the width of the bag, along the entire length of the bag. Additionally, in at least some cases, a special integrated manner of linking neighboring bags, allows for such leakage protection to be effectively extended to prevent leakage through the width of the bag, along the entire length of the bag. Each of these various mechanisms and manners of filling the bag chambers and ultimately the overall flood protection bag can ensure that desired finished dimensions are achieved and also to ensure protection performance.

Also, in another embodiment of the present disclosure, a flood protection system includes a containment structure having a first side, a second side, and a bottom extending between the first and second sides, and at least one internal divider portion, where each internal divider portion extends between the first side and the second side and further to the bottom. Additionally, the containment structure and the at least one internal divider portion at least partly define a series of container regions positioned one by one along the containment structure, and each of the first side, the second side, and the bottom of the containment structure extends in a continuous, seamless manner from alongside a first of the container regions to a second of the container regions. Further, the flood protection system also includes a plurality of fastening devices respectively positioned at or proximate to respective upper corners of at least some of the container regions of the series of container regions. There is a respective one of the fastening devices positioned at or proximate to each of the upper corners of each of the first and second container regions, and the fastening devices are configured to allow all of the upper corners associated with each of the first and second container regions to be supported during a filling of each of the first and second container regions.

In a further embodiment, the present disclosure provides a flood protection system including a containment structure having a first side, a second side, and a bottom extending between the first and second sides, and at least one internal divider or wall portion. Each internal divider or wall portion extends between the first side and the second side and further to the bottom, the containment structure and the at least one internal divider portion at least partly define a series of container regions positioned one by one along the containment structure, and each of the first side, the second side, and the bottom of the containment structure extends in a continuous, seamless manner from alongside a first of the container regions to a second of the container regions. Additionally, the flood protection system includes a plurality of fastening devices respectively positioned at or proximate to respective upper corners of the series of container regions, where each upper corner of each respective container region has a respective one of the fastening devices positioned at or proximate thereto, whereby the fastening devices allow the all of the corners associated with each respective container region to be supported by a frame structure during a filling of the respective container region.

In some embodiments, the present disclosure provides an implementation system for implementing such a flood protection system which includes the flood protection system and further includes at least one frame portion formed as either a stationary structure or as a mobile structure.

In an embodiment, the present disclosure provides a method of implementing a flood protection bag structure that includes: (a) providing the bag structure, (b) attaching at least four primary fastening devices of the bag structure positioned respectively at corners of a single bag chamber of a series of bag chambers of the bag structure to at least four complementary fastening devices attached to a frame structure, (c) causing the single bag chamber to be substantially filled with a filling material, (d) applying downward pressure to at least one portion of the frame structure so as to reduce tension between the at least four primary fastening devices and the at least four complementary fastening devices, thus allowing for the primary fastening devices and complementary fastening devices to be disengaged, and (e) moving the frame structure so that the frame structure is positioned above a different one of the bag chambers of the series of bag chambers, and repeating (b) to (d) at least once.

In a further embodiment, the present disclosure relates to a flood protection system that includes a plurality of bag structures. Each of the bag structures includes respective first and second sides, a respective bottom extending between the respective first and second sides, and a respective plurality of internal divider portions extending between the respective first and second sides and to the respective bottom of the respective bag structure so as to define a respective series of bag chambers within the respective bag structure. A first of the bag structures includes, at a first end thereof, a bag chamber portion bounded by the respective first side, second side, and bottom of the first bag structure and further bounded by a first of the respective internal divider portions of the first bag structure that is positioned inwardly of the first end such that the bag chamber portion is open-ended at the first end of the first bag structure. A second of the bag structures includes, at a first end thereof, a bag chamber bounded by the respective first side, second side, and bottom of the second bag structure and further bounded by two of the respective internal divider portions. The second bag structure is positioned so that the first end and the bag chamber at the first end are positioned into the bag chamber portion of the first bag structure such that the first internal divider portion of the first bag structure is substantially adjacent to a first of the two internal divider portions of the second bag structure.

Other features and advantages of the present disclosure will be apparent from the following detailed disclosure, taken in conjunction with the accompanying sheets of drawings, wherein like numerals generally refer to like parts, elements, components, steps and processes.

DETAILED DESCRIPTION

Various embodiments of the present disclosure provide an elongated flood protection bag having a series of bag chambers arranged side-by-side (e.g., in a longitudinal manner, one-by-one) that can be filled with sand or another filling material or materials (e.g., in addition to sand, one or more of dirt/soil, gravel, rocks, etc.) to form an elongated wall or barrier. The flood protection bag of the present disclosure is intended to be capable of resisting pressure presented against the bags by water arising due to natural floods or other circumstances (e.g., a water main break or dam failure), or possibly by other liquids arising under other circumstances, as well as intended to be capable of simply limiting or preventing leakage or other movement of the water or other liquids beyond the wall/barrier formation formed by the bags.

Figure 1:
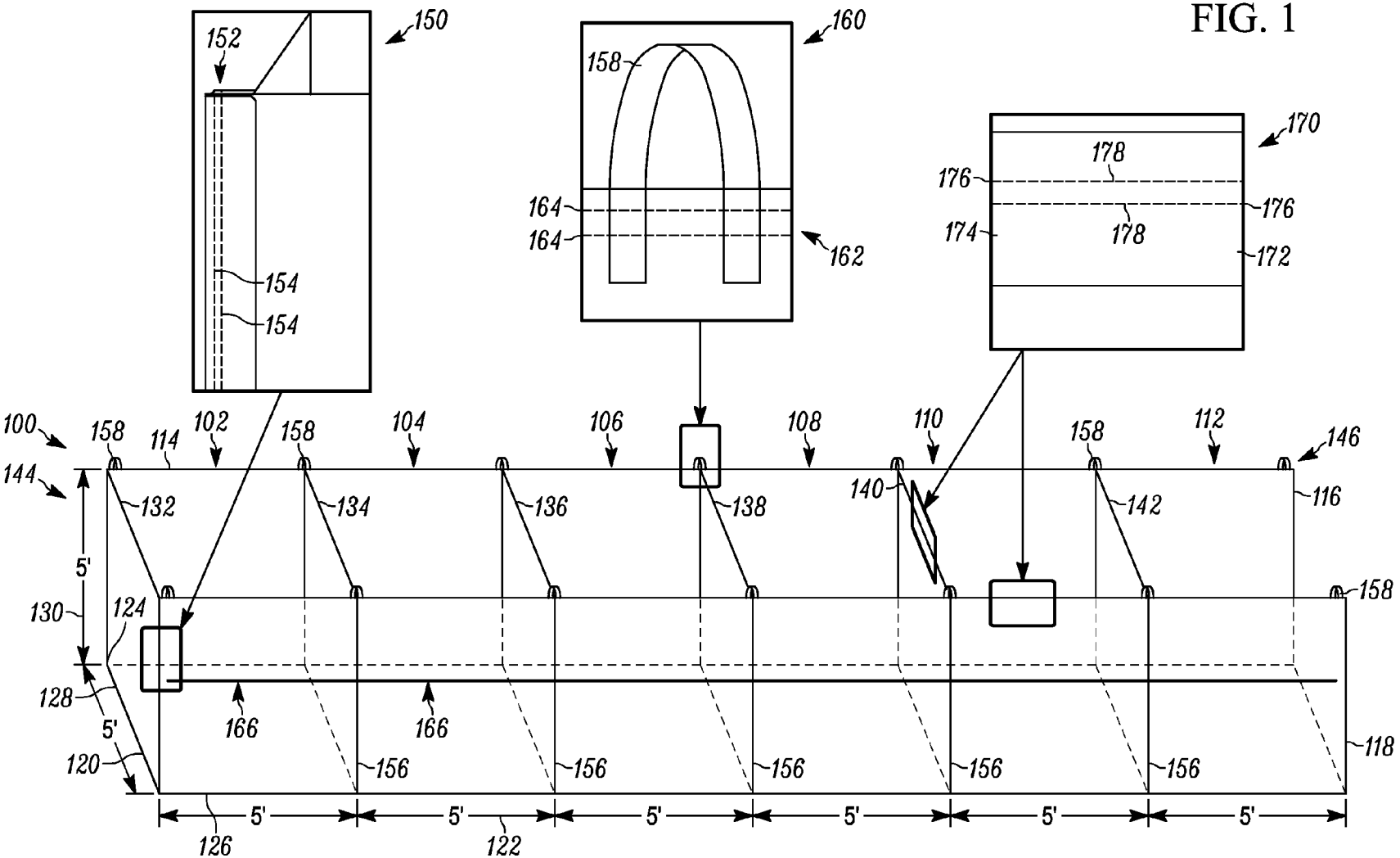
FIG. 1 is a schematic side perspective view of an exemplary embodiment of a flood protection bag, including several enlarged detail views of exemplary embodiments of several subportions of the bag.

In certain embodiments, a flood protection bag system involves the combination of two or more bags linked with one another to form a combination bag system wall/barrier that is even longer than a single bag, as discussed in detail below. Referring now to FIG. 1, an example flood protection bag 100 is illustrated. In the illustrated embodiment, the flood protection bag 100 is a troughlike structure having six internal bag chambers 102, 104, 106, 108, 110 and 112. It should be appreciated that any suitable number of bag chambers may be provided in the flood protection bag 100. For example, although six of the bag chambers 102-112 are shown in the flood protection bag 100 of FIG. 1, in other implementations, the flood protection bag could include 10, 50, or 100 (one-hundred) bag chambers. Assuming a flood protection bag with 20 bag chambers, each 5 feet in length along the longitudinal axis of the bag, the flood protection bag would be 100 feet long.

The flood protection bag 100 includes a main outer wall 114 having first and second side walls (or panels) 116 and 118, respectively, and a bottom wall 120. The side walls 116 and 118 are connected to the bottom wall 120 along an entire length of the flood protection bag 100 along a longitudinal axis 122 extending parallel to first and second bottom edges 124 and 126, respectively. In the illustrated embodiment, the side walls 116 and 118 are seamlessly connected to the bottom wall 120 along an entire length of the flood protection bag 100. The side walls 116, 118 and bottom wall 120 together form a troughlike portion of the flood protection bag 100. It can further be noted that the troughlike portion of the flood protection bag formed by the side walls 116, 118 and bottom wall 120 has a width extending along a width axis 128, as well as a height extending along a height axis 130.

In addition to the main wall 114 including the side walls 116, 118 and bottom wall 120 forming the trough like portion, the flood protection bag 100 additionally has a series of inner or internal walls 132, 134, 136, 138, 140 and 142, respectively, as shown. Each of the internal walls 132, 134, 136, 138, 140 and 142 extends between the first and second side walls 116 and 118 and also is connected to the bottom wall 120. In contrast to the connections between the side walls 116, 118 and the bottom wall 120, which are seamless, the connections between the internal walls 132, 134, 136, 138, 140 and 142, the side walls 116, 118/bottom wall 120 can be established in a variety of manners, including by way of seams/stitching, as well as possibly other fastening mechanisms or processes (e.g., gluing or welding-type processes).

In the illustrated embodiment, each of the internal walls 134, 136, 138, 140 and 142 serves as an internal divider wall between respective pairs of neighboring ones of the bag chambers 102, 104, 106, 108, and 112. More particularly, the internal wall 134 serves as an internal divider wall between the bag chambers 102 and 104, the internal wall 136 forms an internal divider wall between the internal bag chambers 104 and 106, the internal wall 138 forms an internal divider wall between the bag chambers 106 and 108, the internal wall 140 forms a divider wall between the bag chambers 108 and 110, and the internal wall 142 forms an internal divider between the bag chambers 110 and 112.

In contrast to the internal walls 134, 136, 138, 140 and 142, the internal wall 132 is an end wall of the flood protection bag 100 insofar as it is located at a first end 144 of the flood protection bag that is opposite a second end 146 of the flood protection bag (the first and second ends 144, 146 being at opposite ends of the flood protection bag in the longitudinal direction corresponding to the longitudinal axis 122). Further, although the internal wall 132 serves an end wall at the first end 144, as shown there is no corresponding end wall at the second end 146 of the flood protection bag 100 but rather the second end is an open end extending between the side walls 116, 118 and bottom wall 120. The reason for having an open end at the second end in the present embodiment is discussed further with respect to FIG. 3. Nevertheless, in alternate embodiments, an additional internal wall can be positioned at the second end 146 to serve as an end wall.

It should be appreciated that, just as the number of bag chambers can be any suitable number (other than six, as shown in the example embodiment of FIG. 1), there can be any suitable number of internal walls. Indeed, depending upon the embodiment, the number of bag chambers can range from as few as two to a large number of 100 (one-hundred) or even more. Typically, for a flood protection bag containing N bag chambers, the number of internal walls serving as internal divider walls will be N−1 in number.

As illustrated in FIG. 1, a first enlarged detail view 150 shows example corner stitching 152 by which the internal wall 132 constituting the end wall of the flood protection bag 100 is stitched together with the second side wall 118. In the illustrated embodiment, the corner stitching 152 includes two parallel stitch lines 154 for redundancy and strength, albeit the exact stitching employed in any embodiment can vary from that shown and can include, for example, a different number of stitch lines (e.g., one stitch line or more than two stitch lines). Although not illustrated, it should be appreciated that similar stitching can also exist between the internal wall 132 and the first side wall 116, as well as between the internal wall 132 and the bottom wall 120. Further, although not shown, similar stitching can additionally be employed to secure each of the internal walls 134-142 to each of the side walls 116, 118 and to the bottom wall 120. In alternate embodiments, a variety of other types of fastening mechanisms or processes can be employed to attach the various internal walls to the side walls 116, 118 and bottom wall 120 (for example, gluing or welding-type processes).

The example flood protection bag 100 of FIG. 1 additionally includes a multiple stabilizing (or retention) loops 158, one of which is shown in more detail in a second enlarged detail view 160. As shown, respective ones of the stabilizing loops 158 particularly are provided along the top edges of the first and second side walls 116, 118 at each junction (or divider seam) 156 between the side walls and a respective one of the internal walls 134-142, as well as at the upper corners of each of those side walls at the first and second ends 144 and 146. The second enlarged detail view 160 particularly shows how one of the stabilizing loops 158 is stitched to the upper edge of the first side wall 116 to which it is attached. As shown, the stabilizing loop 158 in the second enlarged detail view 160 is stitched to the first side wall 116 at the side wall upper edge (at or approximate to the junction 156 of the side wall 116 with the internal wall 138, which is not shown in the enlarged detail view) by way of stitching 162 that encompasses two parallel stitches 164.

As illustrated in a third enlarged detail view 170, an example divider overlap feature of the flood protection bag 100 is shown. The example divider overlap feature 172 is present along the top edges of each of the internal wall 140 and along a section of the second side wall 118 between the internal walls 140 and 142. It should be appreciated, however, that the divider overlap features 172 is actually representative of similar features (indeed, an effectively continuous feature) that is present along the upper edges of each of the side walls 116 and 118 as well as each of the internal walls 132-142. As shown in the third enlarged detail view 170, the divider overlap feature is one in which an upper region of the respective wall (e.g., side wall or internal wall) includes a dual-layer, folded-over edge section 174 (the fold constituting the upper edge of the respective wall), where the two layers of the folded-over edge section are then stitched together by way of stitching 176. In the illustrated embodiment, the stitching 176 includes two parallel stitches 174, although this can vary. Thus, the upper rim of each of the side walls 116, 118 and each of the internal walls 132-142 in the illustrated embodiment is actually a double layer of the material forming those walls. Providing this dual-layer upper edging around the flood protection bag 100 improves the structural strength of the flood protection bag.

As will be understood from further discussion provided below with respect to FIGS. 4-5, a bag top portion (not shown in FIG. 1) can be coupled to the flood protection bag 100 to cover over and thus enclose or substantially enclose the bag chambers 102-112 (in the case of the bag chamber 112, there would remain its open end at the second end 146 absent a further structure being placed there). To allow for the bag top portion to be coupled to the flood protection bag 100, the flood protection bag further includes in the present embodiment, extending horizontally around the perimeter of the flood protection bag (except possibly at the ends of the bag, along the internal wall 132 or the open end at the second end 146) cover strap loops 166, one of which is shown in FIG. 1 along the second side wall 118 (it being understood that a similar or identical cover strap loop is formed on the first side wall 116). In the illustrated embodiment, the cover strap loops 166 are positioned approximately one-third of the height of the flood protection bag 100 (as measured along the height axis 130) from the top edges of the side walls 116, 118, although this positioning can vary.

Figure 2:
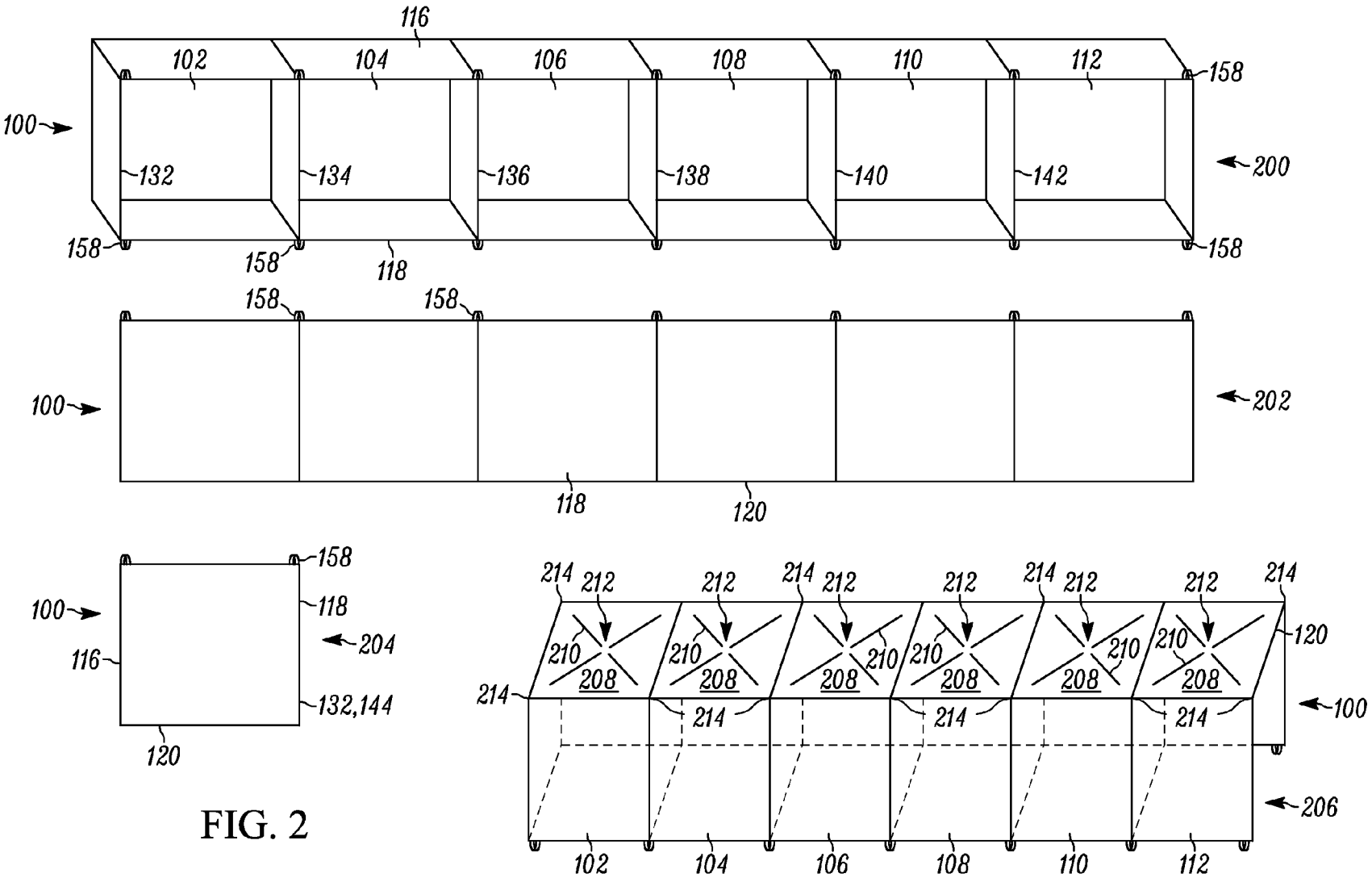
FIG. 2 provides additional top perspective, side elevation, end elevation, and bottom perspective views of the flood protection bag of FIG. 1.

Referring now to FIG. 2, additional top perspective, side, end, and bottom perspective views 200, 202, 204, and 206 respectively, of the flood protection bag 100 of FIG. 1 are provided to further illustrate the flood protection bag. The end view 204 can be considered an end view as would be seen looking at the flood protection bag 100 from just to the side of the first end 144 (although a substantially identical view would be provided if one viewed the flood protection bag from the second end 146, except insofar as such a view would show the open-ended nature of the second end in the present embodiment). The side view 202 is that which would be seen viewing the flood protection bag 100 from either of the side walls 116 or 118, although in the present view the second side wall 118 is particularly labeled as being shown.

As illustrated in FIG. 2, the bottom perspective view 206 particularly shows that the bottom wall 120 of the flood protection bag 100 includes multiple scored bottom sections 208 that are respectively coextensive (or substantially coextensive) with the respective bag chambers 102-112. As illustrated, each of the bottom sections 208 of the bottom surface 120 is scored in a manner such that there are X-shaped cuts 210 extending inwardly to respective center points 212 of each of the X-shaped cuts (the centers of the X's) from respective bottom corners 214 of the respective bag chambers 102-112. That is, at the respective bottom section 208 of each of the bag chambers 102-112, there is a respective one of the X-shaped cuts 210 positioned between the four bottom corners 214 corresponding to that respective bottom section. As discussed further below, the X-shaped cuts 210 assist with the discharging of material from the flood protection bag 100 during disassembly, by tending to facilitate proper discharging of sand or other filling material from the bag chambers 102-112 and the flood protection bag overall.

Figure 3:
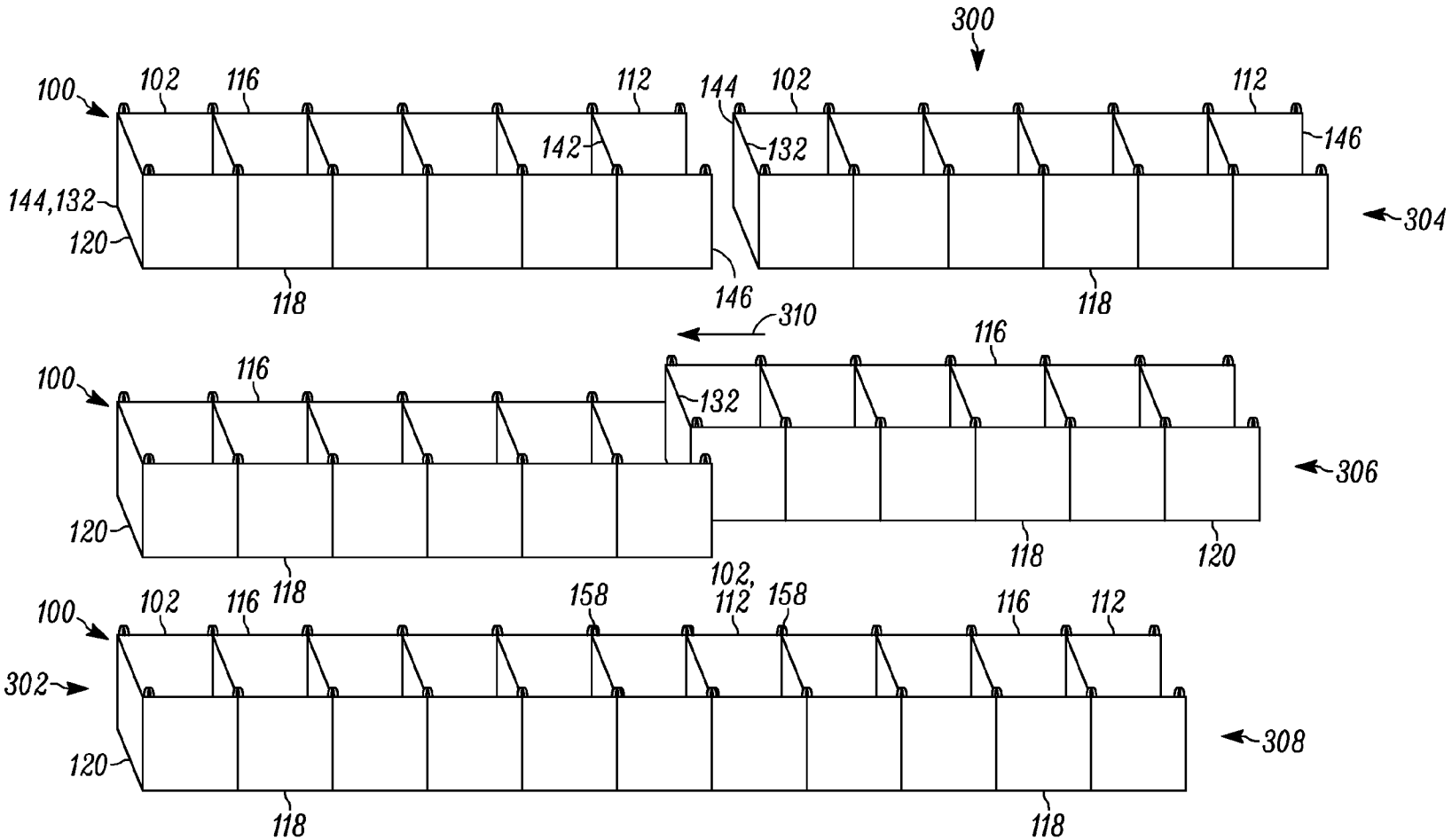
FIG. 3 provides schematic side perspective views of both the flood protection bag of FIGS. 1 and 2 and an exemplary embodiment of an additional flood protection bag at three different stages of a process in which the flood protection bags are assembled into a combination flood protection bag in accordance with exemplary embodiments of the present disclosure.

Referring now to FIG. 3, the flood protection bag 100 is shown with an additional flood protection bag 300 which is identical to the flood protection bag 100. FIG. 3 particularly shows how two of the flood protection bags, namely the flood protection bag 100 and the flood protection bag 300, can be assembled end to end to result in an even longer combination flood protection bag 302. The combination of the flood protection bags 100 and 300 is shown in three different, exemplary stages of completion, namely in a first stage 304, a second stage 306, and a third stage 308. In the view of the first stage 304, the flood protection bag 100 is positioned end-to-end relative to the additional flood protection bag 300. The bag chamber 112 closest to the second end 146 of the flood protection bag 100 is the chamber that is most proximate to the additional flood protection bag 300. By comparison, the first bag chamber 102 of the additional flood protection bag 300 is positioned closest to the flood protection bag 100. Thus, the second end 146 of the flood protection bag 100 is positioned adjacent to the first end 144 of the additional flood protection bag 300.

As discussed above, in the illustrated embodiment, there is no internal wall connecting the first and second side walls 116, 118 and bottom wall 120 of the flood protection bag 100 at the second end 146 of that bag (such is also the case with respect to the additional flood protection bag 300) and, consequently, the second end of the flood protection bag 100 is an open end. Thus, it is possible, as shown in the view of the second stage 306, to move the additional flood protection bag 300 toward and into the bag chamber 112 of the flood protection bag 100, by moving the additional flood protection bag 300 in a direction indicated by arrow 310. As a result of such movement, ultimately the internal wall 132 of the additional flood protection bag 300 moves sufficiently far into the bag chamber 112 of the flood protection bag 100 that the aforementioned internal wall 132 encounters and rests adjacent to the internal wall 142 of the flood protection bag 100 (thus, the open end is for a connector function by which the flood protection bag 100 is coupled to the additional flood protection bag 300).

By aligning the bottom walls 120 of each of the flood protection bag 100 and additional flood protection bag 300, ultimately an underside of the bottom wall 120 of the flood protection bag 300 rests atop an upper (interior) surface of the bottom wall 120 of the flood protection bag 100, and further the outwardly-facing surfaces of the side walls 116, 118 of the additional flood protection bag 300 rest in contact with the inwardly-facing surfaces of the side walls 116 and 118 of the flood protection bag 100. Upon such contact occurring, the flood protection bag 100 and additional flood protection bag 300 together form the combination flood protection bag 302 as shown in the view of the third stage 308.

It should be appreciated that the combination of the flood protection bag 100 and the additional flood protection bag 300 shown in FIG. 3 can occur even though the two flood protection bags each have side walls 116, 118 and bottom walls 120 of identical dimension, since the flood protection bags are not rigid but rather are flexible so as to accommodate the additional flood protection bag 300 fitting inside the bag chamber 112 of the flood protection bag 100 such that the bag chamber 112 of the flood protection bag 100 essentially overlaps the bag chamber 102 of the additional flood protection bag 300. When such overlapping assembly of the two flood protection bags occurs, the respective stabilizing loops 158 associated with the top four corners of the bag chamber 112 of the first flood protection bag 100 overlap substantially the stabilizing loops existing at the upper four corners of the bag chamber 102 of the additional flood protection bag 300.

It should also be appreciated that the overlapping of bags can be performed in an opposite manner such that one bag chamber with an open end (e.g., the bag chamber 112) of one flood protection bag 100 is slid under and around another bag chamber with a closed end (e.g., the bag chamber 102) of the additional flood protection bag 300 (the stabilizing loops of the two bag chambers 102, 112 are then joined/overlapped). Also, it is possible to stack at least two of the flood protection bags 100, one on top of the other vertically, when filled and yet retain a stable overall combination bag flood barrier/wall Although the bag chamber 112 discussed above serving as a connector chamber is shown to be longitudinally aligned with the other bag chambers 102-110, in alternate embodiments, it can be in a different direction (e.g., at a 90 degree angle) relative to the other bag chambers rather than aligned with those other chambers.

The process of combining flood protection bags such as shown in FIG. 3 is advantageous in several regards. First, it should be understood that the above-discussed process can be repeated in relation to any suitable number of flood protection bags, thus allowing for a combination of any suitable number of such flood protection bags end-to-end, and thus allowing for the formation of combination flood protection bags of any suitable length with any suitable number of bag chambers. It should further be appreciated that the individual flood protection bags making up the combination flood protection bag need not all be identical in their characteristics. Rather, different ones of the flood protection bags making up a combination flood protection bag can be of varying lengths and have varying numbers of bag chambers.

Since the side walls 116, 118 and bottom wall 120 of each of the flood protection bag 100 and the additional flood protection bag 300 are seamless along the length of each respective flood protection bag, each of the flood protection bags 100 and 300 naturally prevents leakage from occurring across its width (along the width axis 128). That said, by overlapping the flood protection bags 100 and 300 as shown in FIG. 3, such that the first and second side walls 116, 118 of each of the flood protection bags 100 and 300 overlap to a significant degree (at least overlapping in an amount equaling the length of a given bag chamber of each of the flood protection bags, namely the lengths of the bag chamber 112 of the flood protection bag 100 and the bag chamber 102 of the additional flood protection bag 300), the leak proof (or leak resistant) characteristics of each of the flood protection bags 100 or 300 independently is are extended to be equally or substantially equal true with respect to the combination bag 302.

Figure 4:
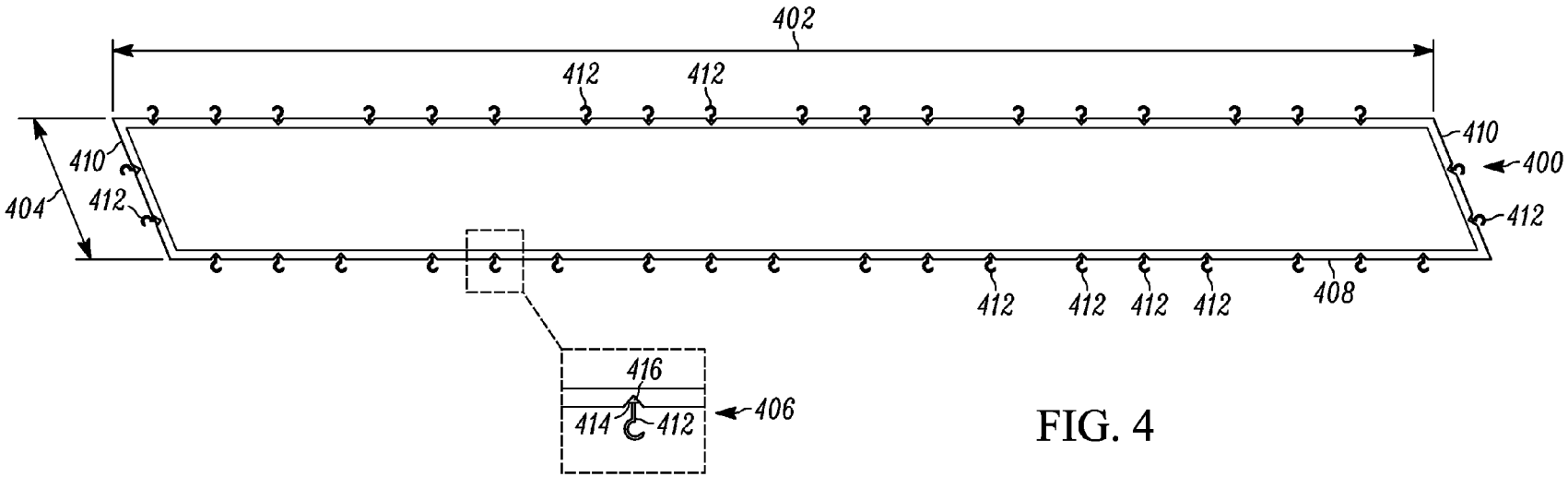
FIG. 4 provides a schematic top perspective view of an exemplary embodiment of a bag top portion that can be attached to the flood protection bag of FIGS. 1-2 so as to more fully enclose bag chambers within the flood protection bag, and additionally includes an enlarged detail view of an exemplary embodiment of one of a plurality of cover hooks of the bag top portion.

Referring now to FIG. 4, an example embodiment of a bag top portion 400 is shown. It should be understood that the bag top portion 400 is complimentary to the flood protection bag 100 of FIGS. 1 to 3 as well as to other flood protection bags of the same type such as the additional flood protection bag 300 of FIG. 3. In particular, the bag top portion 400 is designed to be coupled to the flood protection bag 100 (or other such flood protection bags) once the bag chambers of the flood protection bag are filled with sand or other filling material to whatever extent is desired. As shown in FIG. 4, the bag top portion 400 has an elongated shape and particularly has a length dimension 402 and a width dimension 404. In the illustrated embodiment the length dimension 402 is longer than the length of the flood protection bag 100 (as measured along the length axis 122) and the width dimension 404 is wider than the width of the flood protection bag (as measured along the width axis 128), such that edges of the bag top portion 400 extend and drape over or overlap the side walls 116, 118 and ends 144, 146 of the flood protection bag 100 when assembled thereon. Nevertheless, in other embodiments, the dimensions of the bag top portion 400 can be otherwise. For example, in another embodiment, the dimensions of the bag top portion 400 can be identical to or substantially identical to the length and width of the flood protection bag 100 (e.g., identical or substantially identical to the dimensions of the bottom wall 120). In yet another embodiment, the bag fop portion 400 can have a length to match the length of the flood protection bag (e.g., 100 feet in length) even though the width is wider than that of the flood protection bag (so that the edges drape over the side walls of the bag).

Both the flood protection bag 100 (and other flood protection bags, such as the additional flood protection bag 300 or combination flood protection bag 302) and the bag top portion 400 can be made of any of a variety of materials depending upon the embodiment. Typically, although not necessarily, the flood protection bag 100 and the bag top portion 400 are made of the same or substantially the same material(s). In some embodiments, the flood protection bag 100 and bag top portion 400 are made entirely or substantially entirely from a robust but bendable, flexible, collapsible plastic material, such as polypropylene or polyethylene. In other embodiments, the flood protection bag 100 and bag top portion 400 can instead be made of plastic or other materials that are more rigid.

Further as shown also by way of an enlarged detail view 406 included as part of FIG. 4, the bag top portion 400 includes a plurality of cover hooks 412 along outer side edges 408 of the bag top portion 400 as well as along end edges 410 of the bag top portion. The cover hooks 412 can be attached to the remainder of the bag top portion 400 in a variety of manners depending upon the embodiment. In the illustrated embodiment, as shown each respective cover hook 412 can include a horizontal T-bracket 414 that fits within a complimentary respective slot 416 within the outer side edges 408 of the bag top portion 400 (it being understood that there would be a respective notch for each T-bracket). In other embodiments, the cover hooks 412 can instead be attached to the remainder of the bag top portion 400 in another manner, for example, by attaching the cover hooks to cords or cables extending along the outer side edges 408.

Figure 13:
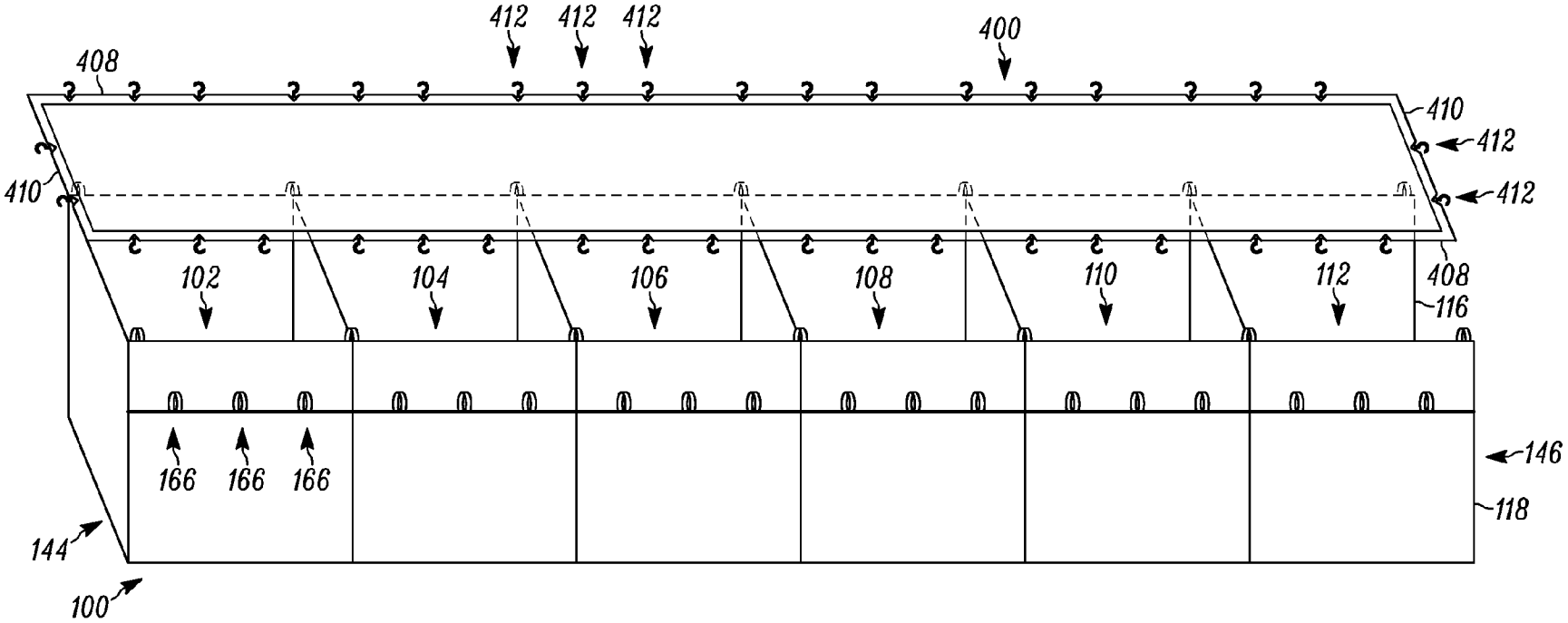
FIG. 13 is a further schematic side perspective view of both the flood protection bag of FIG. 1 and the bag top portion of FIG. 4, with the bag top portion shown to be exploded from the flood protection bag.

Referring additionally to FIG. 13, there the bag top portion 400 is shown in relation to (but still exploded from) the flood protection bag 100. As should be appreciated from FIG. 13, upon placement of the bag top portion 400 atop the flood protection bag 100, one or more of the cover hooks 412 along the outer side edges 408 can be attached (e.g., by an operator) to hook onto the complimentary cover strap loops 166 formed along the sidewalls 116, 118 of the flood protection bag 100. Since the illustrated flood protection bag 100 does not include cover strap loops at its ends 144, 146, the cover hooks 412 of the bag top portion 400 along the end edges 410 do not hook up to the flood protection bag 100. It should further be appreciated, however, that in other embodiments, complementary cover straps or other features can be provided on the flood protection bag to receive and engage the cover hooks 412 along the end edges 412.

Regardless of how many cover hooks 412 are attached to complementary cover strap loops 166 (or other features) of the flood protection bag 100, by attaching the cover hooks 412 to the complementary cover strap loops, the bag chambers 102-112 within the flood protection bag become enclosed or substantially closed, thereby better encasing or containing the filling material within those bag chambers (this will not be entirely the case with respect to the bag chamber 112 to the extent it remains open-ended). Thus, depending upon the embodiment or implementation, the filling material within the bag chambers can be largely (or even entirely) separated from the outside environment. Once a flood protection bag (e.g., a 100 foot bag) has been filled with sand (or other filling material) and the sand leveled, the bag top portion can be attached to keep unwanted elements out and sand inside.

Additionally, although FIGS. 4 and 13 particularly illustrate the bag top portion 400 having the cover hooks 412, in other embodiments one or more other fastening structures or devices can be employed in place of (or in addition to) one or more or all of the cover hooks 412. Likewise, the fastening structures or devices on the flood protection bag 100 (or other bag), to which the fastening structures or devices of the bag top portion are to be fastened, can also vary depending upon the embodiment. For example, in some other embodiments, holes or loops can be provided on the bag top portion to which other fastening devices associated with the flood protection bag (e.g., hooks or other loops) can be attached. Further for example, although in the present embodiment of FIGS. 4 and 13 the cover hooks are on the bag top portion and the cover strap loops are on the flood protection bag, in other embodiments the hooks can be on the flood protection bag and the cover strap loops are on the bag top portion. Additionally for example, not only holes, loops, or hooks, but many other fastening devices and structures as well (e.g., other forms of ties or snaps), and/or a variety of complementary combinations of such structures on the bag top portion and the flood protection bag, are also intended to be encompassed herein.

Figure 5:
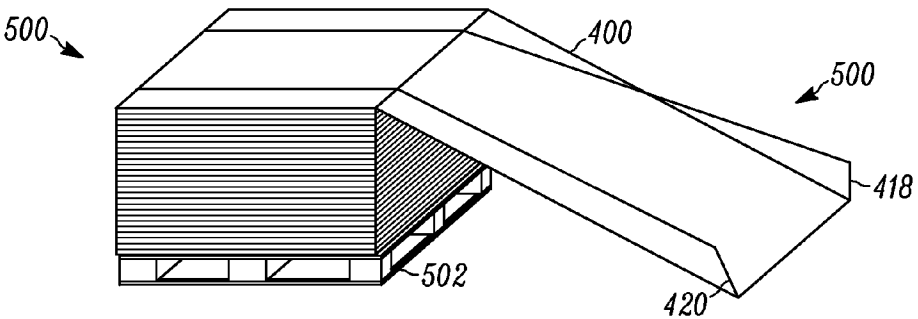
FIG. 5 is a perspective view illustrating how the bag top portion can be folded for storage/transport on a pallet, as well as drawn off of the pallet, in accordance with exemplary embodiments of the present disclosure.

Referring to FIG. 5, it should be understood that the bag top portion 400 (or packed cover) can be folded lengthwise repeatedly into a stacked cover formation 500 as illustrated in FIG. 5 in accordance with exemplary embodiments of the present disclosure. When folded in this manner, the bag top portion 400 can be positioned onto a pallet 502 as shown, which facilitates storage and transport of the bag top portion 400. In at least some circumstances the bag top portion 400 when folded is folded in a manner where side overhand edges 418 and 420 of the bag top portion 400 are additionally folded relative to the remaining (middle) portion of the bag to portion 400. When folded in this manner, the bag top portion 400, when positioned onto a flood protection bag such as the flood protection bag 100, tends to more naturally drape over the side walls 116, 118 of the flood protection bag.

Figure 6:
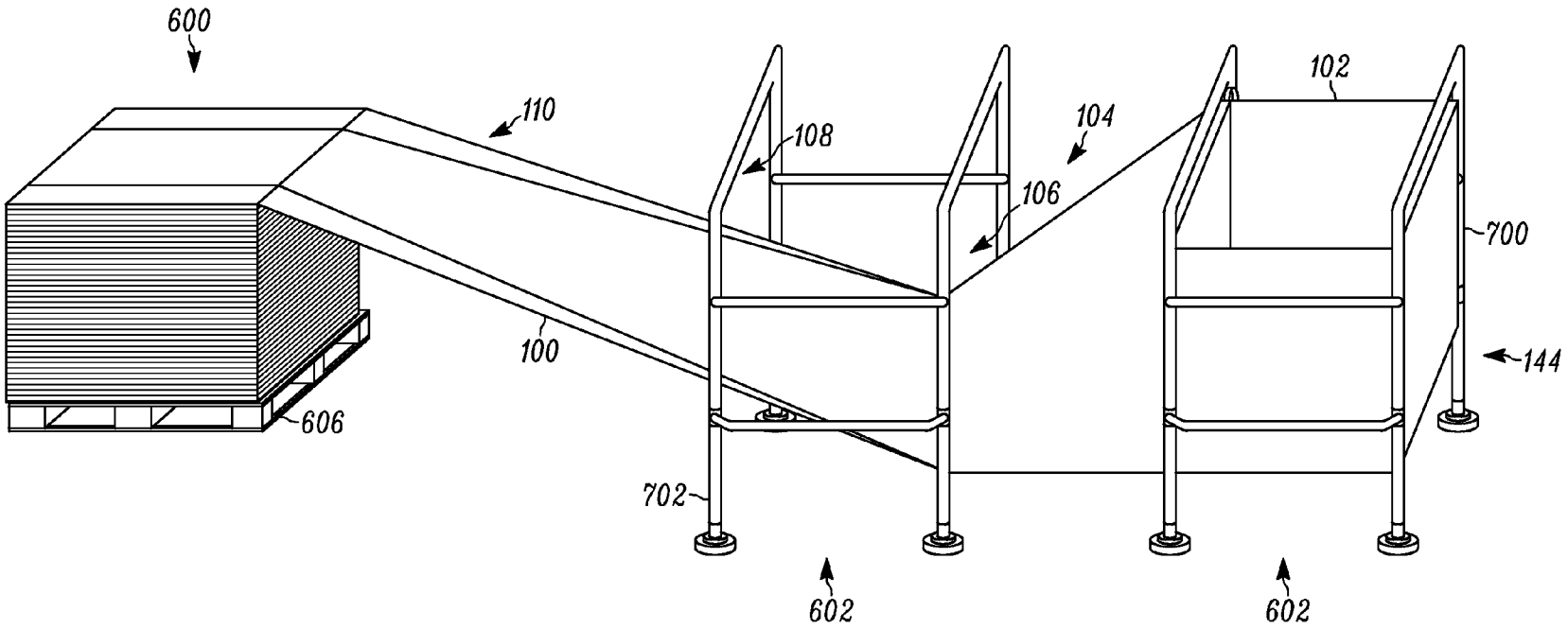
FIG. 6 is a perspective view illustrating how the flood protection bag of FIGS. 1 and 2 can be folded for storage/transport on a pallet as well, as drawn off of the pallet for implementation in a flood protection application, and additionally illustrates a pair of exemplary filling frames that can be employed during such implementation to facilitate filling of bag chambers within the flood protection bag, in accordance with exemplary embodiments of the present disclosure.

Referring now to FIG. 6, just as the bag top portion 400 can be stored in a folded manner as shown in FIG. 5, the flood protection bag 100 (and indeed multiple such flood protection bags including the additional flood protection bag 300 or even a combination flood protection bag such as the bag 302) can be folded in to a folded stack formation 600 to allow for the flood protection bag 100 to be positioned onto a pallet 606, thus facilitating storage and transport of the flood protection bag 100. It is particularly envisioned that a pallet such as the pallet 606 can (but need not) store multiple flood protection bags stacked one on top of the other. Any suitable number of flood protection bags respectively having any suitable length (s) can be included in the stack. The various stacked flood protection bags can be (but need not all be) of the same length, but rather different bags can have different lengths. The lengths can include, for example, lengths of 100 feet, 150 feet, 200 feet, or any other suitable length.

Figure 7:
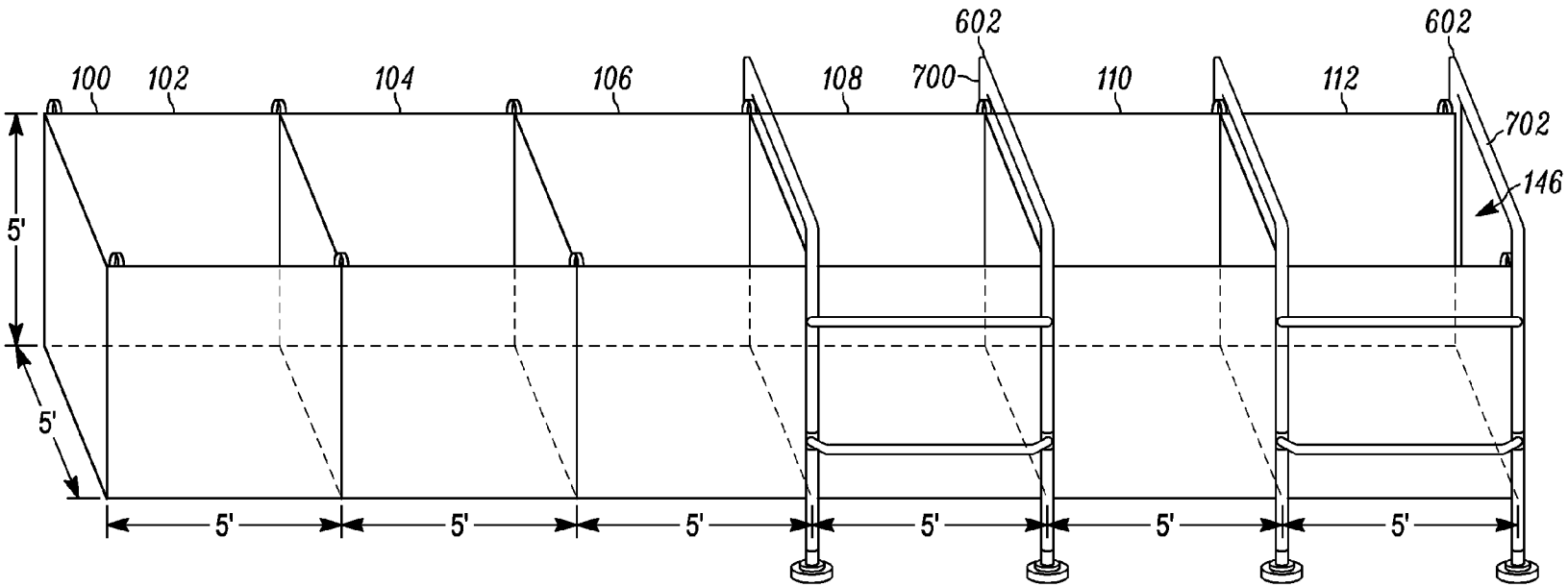
FIG. 7 is a further schematic side perspective view of the flood protection bag of FIG. 1, with two of the exemplary filling frames of FIG. 6 also shown to be positioned in relation to the flood protection bag, in accordance with exemplary embodiments of the present disclosure.

In addition to showing the pallet 606 supporting the folded stack formation 600 of the flood protection bag 100 (plus possibly one or more additional flood protection bags), FIG. 6 also illustrates how the flood protection bags, such as the flood protection bag 100, can be set up to receive sand or other filling material and ultimately deployed as a flood protection system. As shown in FIG. 6 and FIG. 7, two filling frames 602 are shown as being employed for this purpose, although in other circumstances only one of the filling frames 602 (or possibly more than two of the filling frames) can be employed. FIG. 6 illustrates a circumstance where the flood protection bag 100 is just initially being set up, such that the first end 144 and bag chamber 102 are beneath a first one 700 of the filling frames 602 and the flood protection bag then continues to extend underneath a second one 702 of the filling frames as it extends back to the folded stack formation. FIG. 7, by comparison, illustrates a circumstance where some of the bag chambers of the flood protection bag 100 (e.g., the bag chambers 102-106) have already been filled with sand or other filling material (that sand or other filling material not being shown in FIG. 7) and now the subsequent chambers (e.g., the bag chambers 108, 110 and/or 112) are being filled with sand or other filling material. As shown, the first one 700 of the filling frames 602 is positioned over the bag chamber 112 (which can be considered a sixth, or alternatively can be considered a first, of the bag chambers 102-112) while the second one 702 of the filling frames is positioned over the bag chamber 108 (which can be considered a fourth, or alternatively a third, of the bag chambers 102-112), with the two filling frames being spaced apart by the bag chamber 110 (which can be considered a fifth, or alternatively a second, of the bag chambers 102-112).

Further, with respect to FIG. 6, it will be understood that as the flood protection bag 100 is drawn off of the pallet 606 and only a portion of that bag extend under the filling frames 602, the flood protection bag is relatively crumpled under one of the two filling frames 602. By comparison, after the flood protection bag 100 has been fully removed from the pallet 606, it is no longer crumpled, as shown in FIG. 7. It can also be noted that, while FIG. 7 shows the second one 702 of the filling frames 602 to be positioned over the bag chamber 112 at which the flood protection bag 100 is open ended at the second end 146, during typical operation and set up neither of the filling frames 602 are typically positioned above a completely open-ended bag chamber. Rather, typically both of the frames 602 are positioned over and around bag chambers with respect to which all four sides are closed (e.g., the bag chambers 102, 104, 106, 108 and 110).

Figure 8:
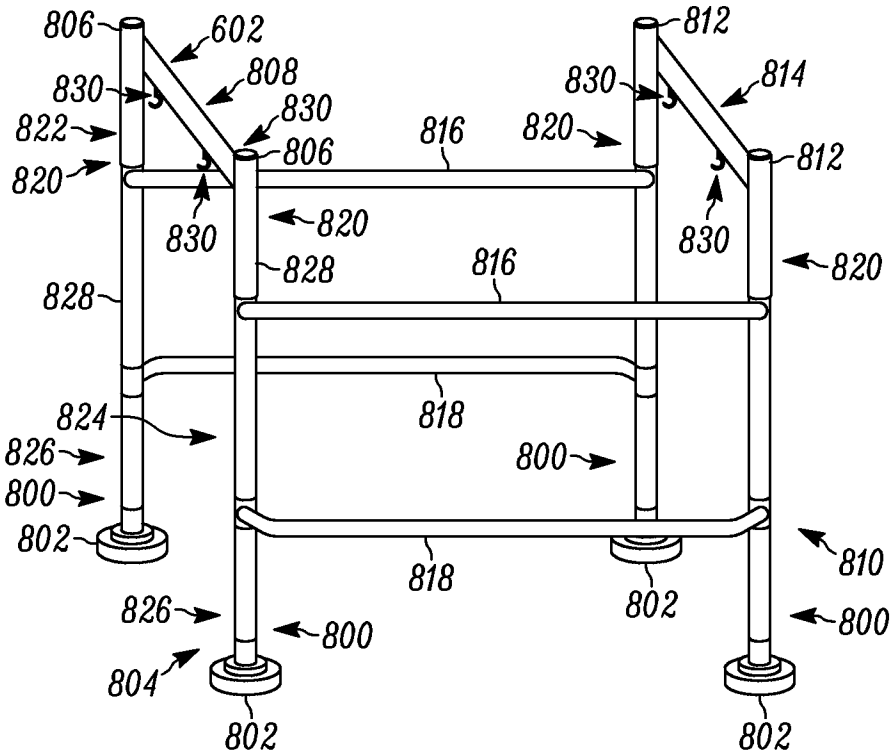
FIG. 8 is a side perspective view of one of the filling frames of FIGS. 6 and 7 showing with more particularity several components thereof, in accordance with exemplary embodiments of the present disclosure.

Referring to FIG. 8, the example components of one the filling frames 602 (e.g., the first one of the filling frame 700) are shown in more detail. Each filling frame 602 is particularly designed to allow for relatively easy filling by operators who are manually or semi-manually attempting to set up a flood protection barrier/wall through the use of one or more of the flood protection bags 100 (or bags 300 or 302). The filling frame 602 can be considered a light duty filling frame suitable for use with flood protection bags that are intended to support relatively light amounts of sand or other filling material. Nonetheless, this type of filling frame can also be used for any suitable implementation of flood protection bags. The filling frame 602 can be made of PVC pipe or other materials depending upon the embodiment.

As shown in FIG. 8, the filling frame 602 includes four frame legs 800 positioned at four corners of the filling frame. Referring additionally to FIGS. 6 and 7, it can be seen that the spacing/positioning of the legs 800 generally is intended to be such that the four legs can, during implementation of the flood protection bag, be positioned adjacent to the four corners of each of the bag chambers 102-112 of the flood protection bag 100 (which correspond to the corners 214 shown in FIG. 2) when the respective bag chambers are fully extended. Each of the legs 800 includes a respective frame pad or platform 802 at its respective bottom, by which the legs 800 and the filling frame 602 are supported relative to the ground.

A first pair 804 of the legs 800 are coupled at respective top ends 806 of those legs by way of a respective top bar (or top connecting bar) 808, while a second pair 810 of the legs 800 are connected at respective top ends 812 of those legs by way of a second fop bar 814. Each of the top bars 808 and 814 includes expansion tubing (or telescoping tubing) such that the legs 800 of the first pair 804 can be spread closer or farther apart from one another and also the legs 800 of the second pair 810 can likewise be spread farther or closer with respect to one another. Further, as shown, each of the top bars 808, 814 includes a plurality of lifting hooks 830 (in this case, each top bar includes two such hooks) discussed further below.

In addition to the top bars 808, 814 and associated lifting hooks 830, the legs 800 are connected by way of a pair of top lifting handles 816 and a pair of bottom lifting handles 818 as shown. A first of the top lifting handles 816 connects first ones of the legs 800 of the first and second pairs 804 and 810, respectively, while a second of the top lifting handles 816 connects second ones of the legs 800 of the first and second pairs 804 and 810, respectively. A first of the bottom lifting handles 818 connects the first ones of the legs 800 of the first and second pairs 804 and 810, respectively, while a second of the bottom lifting handles 818 connects the second ones of the first legs 800 of the first and second pairs 804 and 810, respectively. The top lifting handles 816 are positioned substantially higher than the bottom lifting handles 818 as shown.

Given the construction of the filling frame 602, the filling frame by way of the top bars 808, 814 is able to be positioned so as to extend over the flood protection bag 100 when the flood protection bag is positioned under the filling frame, with the top bars 808, 814 particularly extending over the flood protection bag as shown in FIGS. 6 and 7. During implementation of the flood protection bag 100, a first side 822 of the filling frame 602 will be positioned along the first side wall 116 of the flood protection bag while a second side 824 will be positioned along the second side wall 118 of the flood protection bag 100. When the filling frame 602 is positioned over the flood protection bag 100, the top and bottom lifting handles 816 and 818 extend along exterior surfaces of the respective side walls 116 and 118 of the flood protection bag.

As shown in FIG. 8, each of the legs 800 additionally includes, between the respective top lifting handle 816 connected to the respective leg and the respective upper end 806 or 812 (as applicable) of the respective leg, a respective protection sleeve 820 that surround the tubing of the respective leg. The protection sleeves 820 serve to protect the legs from damage particularly when the flood protection bag 100 is under the frame 602 and being filled with sand or other filling material, particularly by way of a mechanized loading mechanism such as a loader. Additionally, each of the legs 800 also includes a respective spring mechanism 826 linking the respective frame pad 802 of the respective leg with a remaining upper portion 828 of the respective leg (which includes the protective sleeves 820 of the leg). As will be discussed further below, the existence of spring mechanisms 826 allows for vertical compression of the filling frame 602 such that the top bars 808, 814 can be effectively raised or lowered relative to the frame pads 802 and the ground upon which the frame pads rest, depending upon pressure applied thereto.

Figure 9:
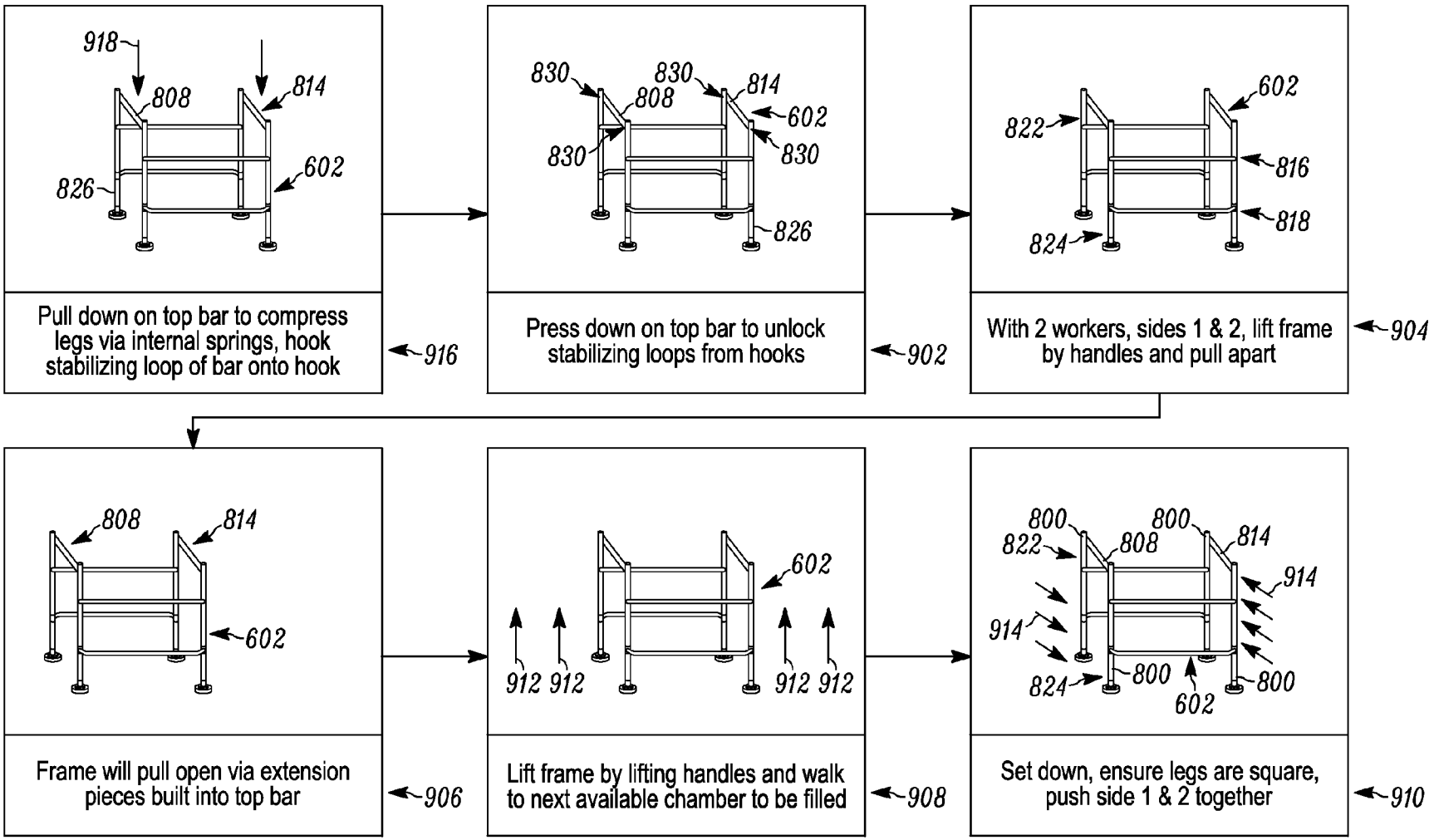
FIG. 9 is a process diagram illustrating several steps of a process by which the flood protection bags of FIGS. 1-3 and 6-7 can be filled using one or more of the filling frames of FIGS. 6-8, in accordance with exemplary embodiments of the present disclosure.

Referring now to FIG. 9, example steps of utilizing the filling frame 602 to fill the flood protection bag 100 (or the flood protection bag 300 or combination flood protection bags encompassing multiple such flood protection bags such as the combination bag 302) are shown in more detail. It should be appreciated that this process may be implemented by persons (e.g., two people) who operate and move the filling frame as discussed below, in combination with one or more other persons or machinery that serve to actually load sand or other filling material into the bag chambers of the flood protection bag. It should also be appreciated that the flood protection bags as discussed herein can be filled in a variety of manners, for example, manually by way of workers with shovels or other scooping equipment, or by way of tractors (e.g., bobcat tractors, 0.5 yard bucket tractors, or 3 yard bucket tractors) or loaders capable of scooping and moving buckets of sand or other filling material, or by way of a conveyor belt mechanism such as a telescopic placing conveyor or telebelt.

In FIG. 9, no flood protection bag is shown; however, it should be understood that these steps all are intended to be performed when a flood protection bag extends underneath the filling frame 602 shown. Thus, notwithstanding the steps shown in FIG. 9, the process begins by way of a preliminary step (not shown) in which the flood protection bag 100 (or portion thereof of a combination flood protection bag) is positioned so as to extend under the filling frame 602 such that one of the bag chambers of the flood protection bag (such as the bag chamber 102 shown in FIG. 6) is positioned underneath the filling frame 602 and the respective legs 800 of the filling frame are positioned adjacent the respective corners of that bag chamber.

Referring to FIG. 9 in more detail, in a step 916 a bag chamber currently positioned underneath the filling frame 602 (e.g., the bag chamber 102) will be filled with sand or other filling material. The operators prepare the flood protection bag 100 (or other combination bag) and particularly the bag chamber of interest that is intended to receive sand or other filling material. To allow for filling, at the step 916 operators push downward upon the top bars 808, 814 of the filling frame 602 to compress the filling frame downward as accommodated by way of the spring mechanisms 826 and as illustrated by arrows 918. Once the top bars 808, 814 are sufficiently lowered that the lifting loop hooks 830 can engage the stabilizing loops 158 at the corners of the desired bag chamber (again, e.g., the bag chamber 102), then the lifting loop hooks are so engaged by the operators and then the operators can release the top bars 808, 814 thus allowing the external side surfaces of the bag chamber of interest (including both the corresponding sections of the side walls 116, 118 of the flood protection bag 100 as well as the corresponding internal walls 132, 134 forming that bag chamber) to be placed under tension and thus in an appropriate state for receiving the sand or other filling material. The connection of the lifting loop hooks 830 to the stabilizer loops 158 in particular helps maintain the upright positioning of the side walls 116, 118 and internal walls (in this case, the internal walls 132, 134) forming the bag chamber, that is, helps to prevent or entirely prevent the bag chamber from collapsing as the sand or other filling material is provided into the bag chamber.

Once the bag chamber (e.g., the bag chamber 102) has been filled, the lifting loop hooks 830 are disengaged from the stabilizing loops 158 at a step 902. In order for this to occur, however, the operators take action to overcome the tension between the hooks and the stabilizing loops by pressing downward on the top bars 808, 814 of the filling frame 601. Downward movement of the top bars 808, 814 is accommodated by the spring mechanisms 826, which resist such movement but nevertheless allow it when appropriate pressure is applied by the operators to the top bars. When the fop bars 808, 814 are pressed sufficiently downward, it is possible for the operators to then unlock the stabilizing loops 158 from the lifting loop hooks 830. At that time, the top bars 808, 814 can be released by the operators, thus allowing the filling frame 602 to return to its natural height.

At a step 904, the filling frame 602 is moved to a subsequent one of the bag chambers, such as the bag chamber 104 or even the bag chamber 106 to allow for filling of that subsequent bag chamber. In order to do this, typically it is desirable that the legs 800 of the first and second sides 822 and 824, respectively, of the filling frame 602 be moved apart so that those legs 800 are not overly close to (much less in contact with) the side walls 116 and 118 of the flood protection bag 100. Thus, at the step 904, two (or potentially more) operators are positioned on the opposite sides of the filling frame 602 and those operators lift the frame by way of either the top lifting handles 816 or the bottom lifting handles 818 on opposite sides of the filling frame and pull apart the first and second sides 822, 824 of the filling frame sufficiently that the legs 800 are not any longer excessively close to the side walls 116, 118 of the flood protection bag 600. As illustrated further by a step 906, the sides 822 and 824 of the filling frame 602 are allowed to come farther apart from one another as accommodated by the expansion tubing (or extension pieces) found in the top bars 808 and 814. Typically, the pulling apart of the sides of the frame can be accomplished by two worker, one on each side of the frame, pulling apart the frame by grasping each of the top and bottom lifting handles along the respective sides (with the worker's one hand on the top lifting handle of a side and the worker's other hand on the bottom lifting handle of that side).

At a step 908, the operators move the filling frame 602 to a different location so as to extend over a different one of the bag chambers (again such as the bag chamber 104 or even the bag chamber 106). This is accomplished by the operators lifting the filling frame 602 by way of the either the top or bottom lifting handles 816 and 818 (one or more as appropriate) upward (along arrows 912) and physically lifting and walking along with the filling frame 602 to an appropriate downstream position along the flood protection bag 100 such that the filling frame then extends over the subsequent appropriate bag chamber. Upon reaching the appropriate downstream position, the operators then lower the filling frame 602 (contrary to the direction of the arrows 912) back to the ground. The frame pads 802 should be set to the ground as level as possible.

At a step 910, the operators set the filling frame 602 down in such a way as to ensure that the legs 800 of the filling frame are substantially square relative to the flood protection bag 100 and particularly in relation to the bag chamber of interest (again, potentially the bag chamber 104 or 106). As illustrated at the step 910 by the arrows 914, the sides 822 and 824 of the filling frame 602 are compressed by the operators relative to one another as accommodated by way of the expansion tubing of the top bars 808, 814 until the legs 800 are sufficiently close to the side walls (the exterior side surfaces thereof) 116, 118 of the flood protection bag 100 (or other combination bag). At such time, the four legs 800 are respectively adjacent to the respective four corners of the bag chamber of interest (e.g., adjacent to the corners 214 at the bottom of the bag chamber).

Although not shown in FIG. 9, it should be appreciated that the sequence of steps 916, 902, 904, 906, 908, and 910 may be repeated any suitable number of times, allowing for the filling of one or more of the bag chambers in addition to the first bag chamber (e.g., the bag chamber 102) that was already filled as discussed above. It should also be appreciated that the process as discussed above may conclude with performance of the step 902, when the last bag chamber to be filled has been filled and disengaged from the filling frame 602.

Figure 10:
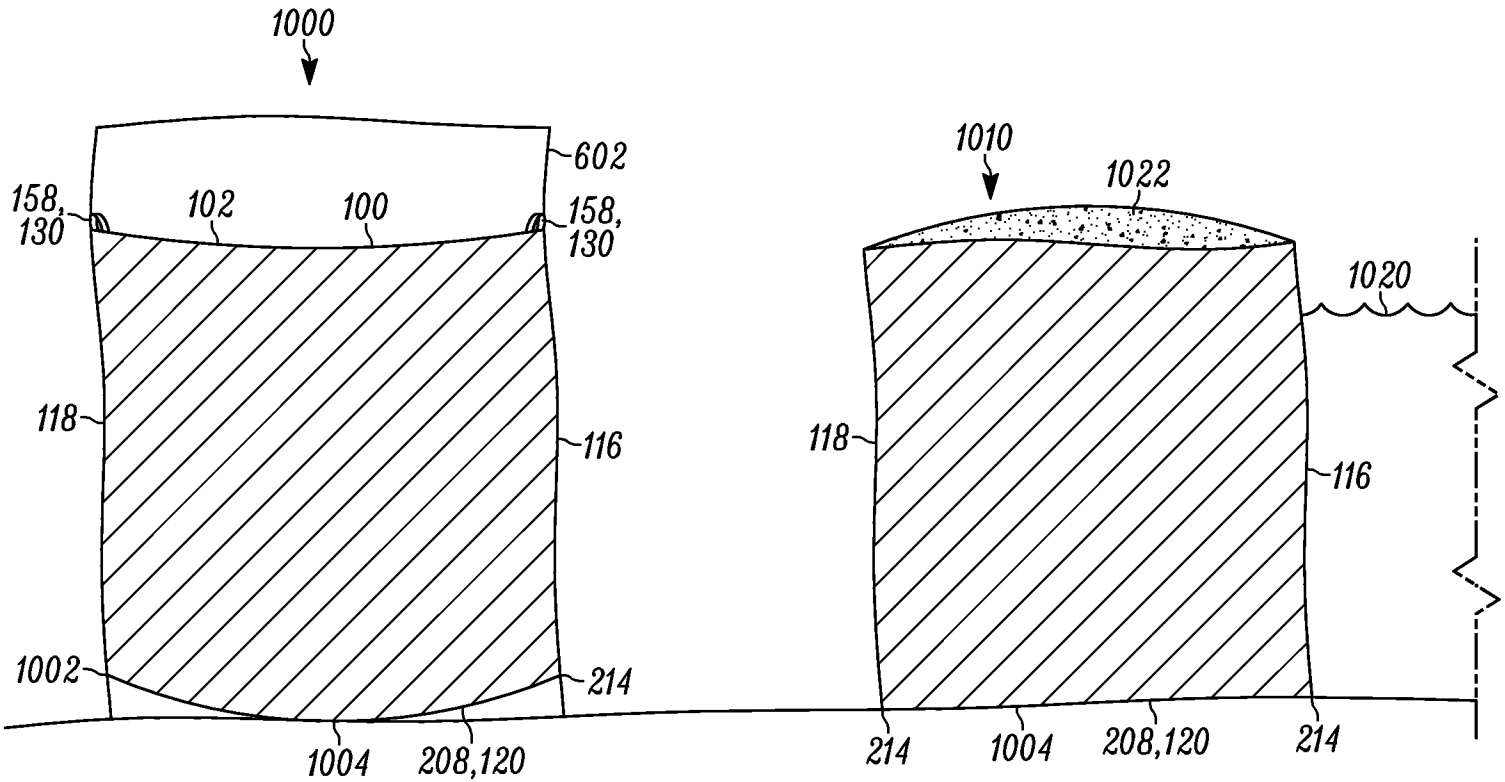
FIG. 10 provides two different end elevation views of the flood protection bag of FIG. 6 (which can correspond to the end elevation view provided in FIG. 2) to illustrate in more detail, and in accordance with exemplary embodiments of the present disclosure, example shapes taken on by an example one of the bag chambers of the flood protection bag prior to and/or as it is being filled with a filling material, and also after it is filled with the filling material, said example shapes being also substantially representative of the bag chamber shape taken on, as viewed from each side of the bag chamber.

Referring now to FIG. 10, first and second additional end elevation views 1000 and 1010 are provided to illustrate certain aspects of the flood protection bag 100 (that also can be present with respect to the bags 300, 302 discussed above) that particularly allow for filling of the bag chambers 102-112 to occur in a manner that results in desirable filling and ultimately straight and consistent implementation of the flood protection bag.

More particularly, as shown in FIG. 10, when a given bag chamber of the flood protection bag 100 such as the bag chamber 102 is empty but suspended in relation to the filling frame 602 by way of the stabilizing loops 158 and lifting loop hooks 830, the bag chamber 102 underneath the filling frame 602 fakes on a shape such that bottom corners 214 of the bag chamber 102 are elevated relative to the ground (e.g., by 5 inches). At the same time, however, a central bottom point or section 1004 of the bag chamber 102 is still in contact with the ground or at least in closer proximity thereto than are the corners 214. It should be appreciated that this is true with respect to each of the four corners 214 associated with the bottom wall 208 (notwithstanding that FIG. 10 shows particularly the endmost corners 214 at the first end 144 of the flood protection bag 100). Thus, the bottom wall 208 takes on a convex shape as illustrated in FIG. 10 when the bag chamber 102 is suspended in this manner.

Further, it should be appreciated that, until such time as the bag chamber 102 is loaded to a sufficient extent with sand or other filling material, it will retain to lesser or greater degrees this convex shape. As the bag eventually becomes fully loaded by the sand or other filling material, the weight of the sand or other filling material will tend to apply compression pressure upon the spring mechanisms 826 of the filling frame 602 such that the corners 214 are progressively lowered or become closer to the ground. As shown by a view 1010 shown in FIG. 10, the filling frame 602 is eventually removed and the bag chamber is allowed to rest along the ground without any tension applied by the filling frame, within filling material 1022 therewithin (and potentially but not necessarily sticking somewhat out of the bag chamber). Thus, the corners 214 rest along the ground as does the central section 1004. Although the sand or other filling material can protrude out of a bag chamber upon the bag chamber being filled, typically the sand or other filling material within a given bag chamber will be leveled to allow for later attachment of the bag top portion/cover.

Even though the corners 214 ultimately come to rest along the ground when the bag chamber 102 is completely filled, the initial convex shape of the bottom wall 208 that exists prior to and during the filling process results in the bag chamber being filled in such a manner that, ultimately, both the bag chamber and (when multiple bag chambers are filled) the overall flood protection bag is straighter and more consistent in shape (and with fewer bulges or wrinkle-type features) than would otherwise be the case. This manner of filling provides greater stability of the overall wall/barrier established by the flood protection bag 100 when encountering flood waters 1020 as shown. That is, the flood protection bag 100 ultimately is more stable, avoids leaning and also avoids wrinkles that may otherwise impact stability when filled, and the flood protection bag is ultimately more taut with straighter sides than would otherwise be the case.

It should be appreciated that, the filling of the flood protection bag 100 (or bags 300, 302) through the use of the filling frames 602, can proceed in a variety of additional or alternate manners depending upon the embodiment. In some embodiments, for example, filling occurs with two of the filling frames 602 consistently positioned apart from one another in such a manner that the filling frames are spaced apart by a given one of the bag chambers. For example, as shown in FIG. 7, the first one 700 of the filling frames 602 is positioned above the bag chamber 108 while the second one 702 of the filling frames 602 is positioned above the bag chamber 112, but neither of the filling frames is positioned above the bag chamber 110. By use of such an arrangement, the two filling frames 602 jointly serve to suspend (apply tension to) not merely two adjacent ones of the bag chambers such as the bag chamber 110 and 112 or the bag chambers 108 and 110, but rather collectively operate to suspend three of the bag chambers, such as the bag chambers 108, 110 and 112, all at the same time. This can be beneficial since spillage of the sand or other filling material, even if it happens to spill over a region encompassing more than two of the bag chambers, still need not result in deformation or collapsing of a portion of the flood protection bag. This can be particularly advantageous when filling of the bag chambers is done in a rapid manner or by way of inexact machinery such as a three yard bucket tractor with a large shovel operated in a speedy manner by an operator operating under rushed or stressful conditions.

Figure 11:
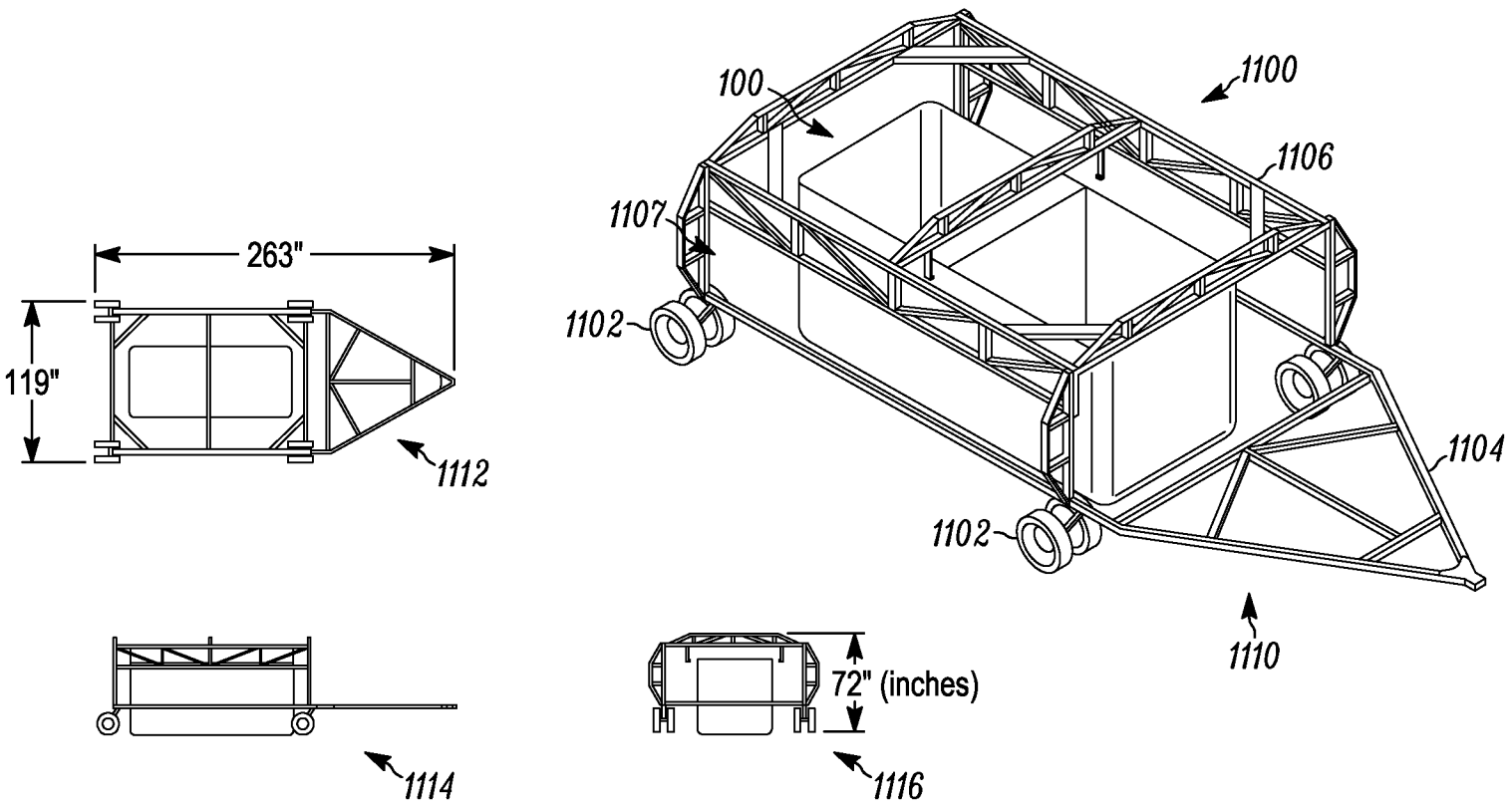
FIGS. 11 and 12 show various views of exemplary embodiments of first and second additional wheel-mounted filling frames that can be employed instead of, or in addition to, the filling frames of FIGS. 6-10, to implement flood protection bags such as those discussed with respect to the other FIGS.

Further, depending upon the embodiment, a variety of other support structures other than the filling frame(s) 602 can be employed to allow or facilitate the proper filling of a flood protection bag such as the flood protection bag 100 (or bags 300, 302). Some of these other embodiments are well suited in some circumstances for higher-load implementations by comparison with the use of the filling frame(s) 602, which is particularly suited for (but not necessarily limited to use with)

lighter-load implementations. FIG. 11 for example shows an example medium duty filling frame formed on (as part of) a movable cart 1100 having swivel caster wheels (which in the present embodiment are dual swivel caster wheels) 1102 allowing for easy maneuverability and a swiveling hitch 1104 that allows for easy towing of the cart. The cart 1100 can include multiple frame portions 1106 that are preferably light in weight steel hollow structural sections that again include hooks that can engage stabilizing loops of a bag such as the flood protection bag 100 shown (neither the hooks nor the stabilizing loops are shown in FIG. 11), with such engagement allowing for the filling frame to provide tension and support to the flood protection bag during the filling operation. The steel frame 1106 also preferable includes large open areas (for example, an area 1107) to allow operator access. For convenience, FIG. 11 provides not only a side perspective view 1110 of the cart 1100 but also top plan, side elevation, and front views 1112, 1114, and 1116, respectively, thereof.

Figure 12:
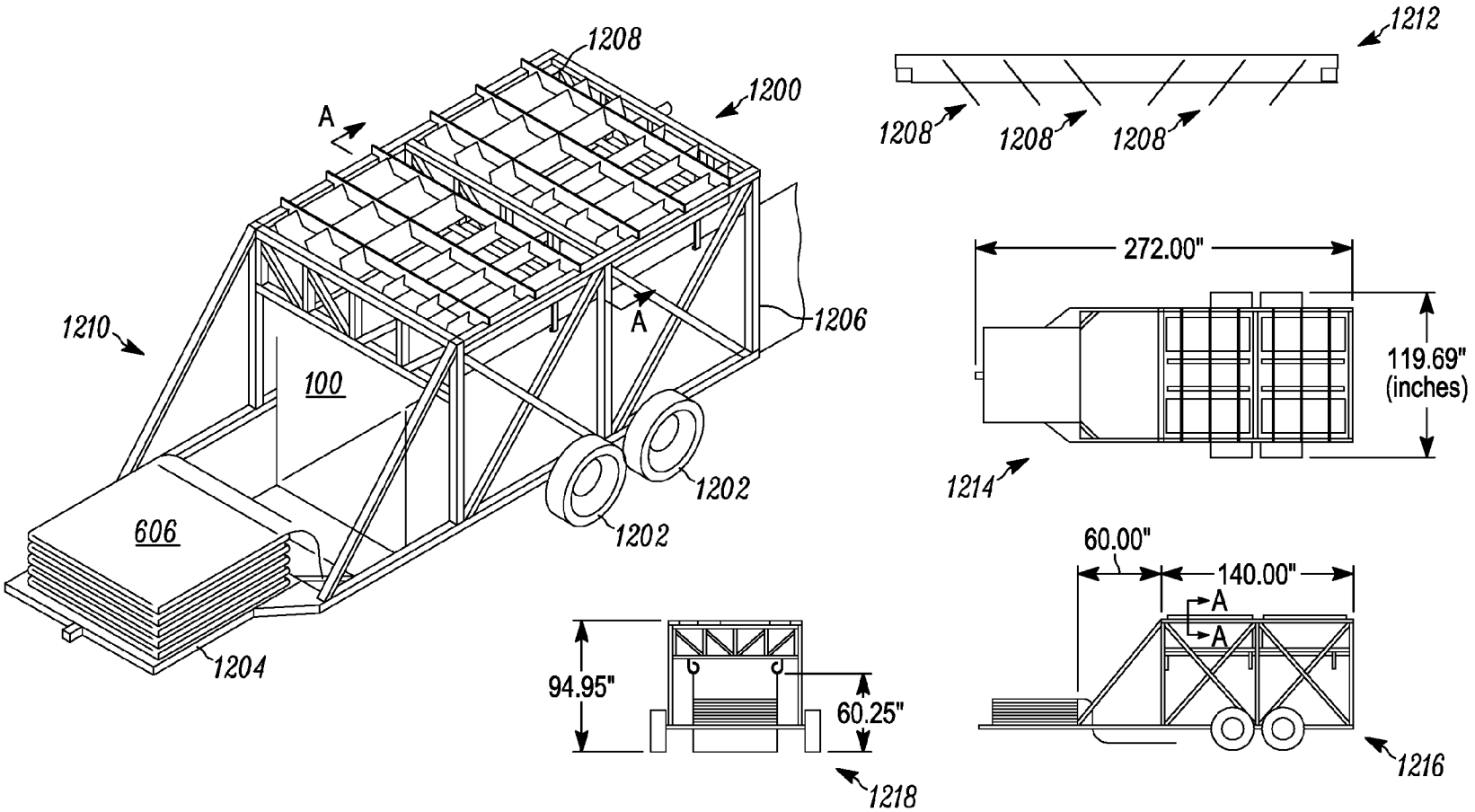

As shown in FIG. 12, a further cart 1200 can be used for particularly heavy-duty filling, as a heavy duty filling frame. FIG. 12 particularly shows a side perspective view 1210 of the cart 1200, plus an additional cross-sectional view 1212 taken with respect to a line A-A of the side perspective view, as well as a top view 1214, a side elevation view 1216, and a front view 1218 of the cart 1200. In contrast to the cart 1100, the cart 1200 has four wheels attached to stub axles with 3600 pound, carrying capacity (four stub axels in all). Also, the cart 1200 has a front platform 1204 on which the pallet 606 supporting bags can be positioned (allowing for on-cart folded bag storage). As shown, the flood protection bag 100 being filled through use of such cart proceeds through an interior section of the cart 1200 enclosed by steel structural sections forming an overall frame 1206 of the cart 1200 (the structural sections can be hollow structural sections that are square and/or rectangular). By comparison with the cart 1100, the cart 1200 additionally includes diffuser members 1208 formed along a top of the cart, which assist with even loading of the bags, as is further illustrated in the cross-sectional view 1212 taken along a line A-A of the side perspective view 1210 (which particularly focuses upon some of the diffuser members). It should be additionally appreciated that the appropriate mechanisms employed for filling the flood protection bag can depend upon a variety of concerns including, for example, the physical location of the bag (e.g., on a paved surface versus on a rough terrain) and the size of the filling equipment/machinery that are available for use in filling the bag with sand or other filling material. It should be further appreciated that, notwithstanding any indications of dimensions shown in FIGS. 11 and 12 with respect to the carts 1100 and 1200, these dimensions are merely examples and the carts and portions thereof can take on a variety of dimensions depending upon the embodiment. Also, the particular arrangements and configurations of structural components, including the steel frame portions thereof, can vary depending upon the embodiment.

It should be appreciated that, once a flood barrier/wall involving one or more of the flood protection bags 100 (or 300, 302) is no longer needed, removal of sand or other filling material from the flood bag portion 100 (e.g., once a flood has subsided) and eventual deconstruction of the bag(s) can be accomplished in a variety of manners. One manner of disassembly is to use an industrial mobile vacuum truck to remove the sand or other filling material from the flood bag portion 100 (the sand is collected in the truck and then dumped ready for a tractor to pick up and load), after which the flood bag portion 100 can itself be removed. Another manner of disassembly (particularly of value when reuse of the bag after disassembly is not of interest) is to use a tractor with front bucket, which will pick up one edge of the final filled flood protection bag (or chamber(s) of the bag). In such an implementation, there need not be a bag chamber serving as a connector chamber for another flood protection bag. Rather, sand from the final filled chamber will rush out the bottom of the bag chamber, particularly if the bottom of the bag chamber has been scored to rip (this can be achieved by way of the X-shaped cuts discussed above). Once the sand has escaped the bottom of the bag it can be bucketed away via tractor and the empty chamber can then be folded onto of the next chamber.

Notwithstanding the above discussion, it should be appreciated that numerous variations are possible with respect to one or more of the features of the flood protection bag and/or bag top portion and that embodiments with such variations are intended to be encompassed within this disclosure. For example, referring to FIGS. 14 and 15, in one exemplary alternate embodiment, a flood protection bag 1400 includes many of the same features as the flood protection bag 100 of FIG. 1 but also certain differences. More particularly, the flood protection bag 1400 is identical (or substantially similar) to the flood protection bag 100 in terms of having six internal bag chambers 1402, 1404, 1406, 1408, 1410, and 1412 respectively corresponding to the bag chambers 102, 104, 106, 108, 110, and 112, respectively. Also, the flood protection bag 1400 has a main outer wall 1414 having first and second side walls (or panels) 1416 and 1418, respectively, which correspond to the walls 114, 116, and 118. Additionally, the flood protection bag 1400 has a bottom wall 1420 corresponding to the bottom wall 120, and first and second bottom edges 1424 and 1426 of the bottom wall corresponding to the first and second bottom edges 124 and 126, respectively.

Figure 14:
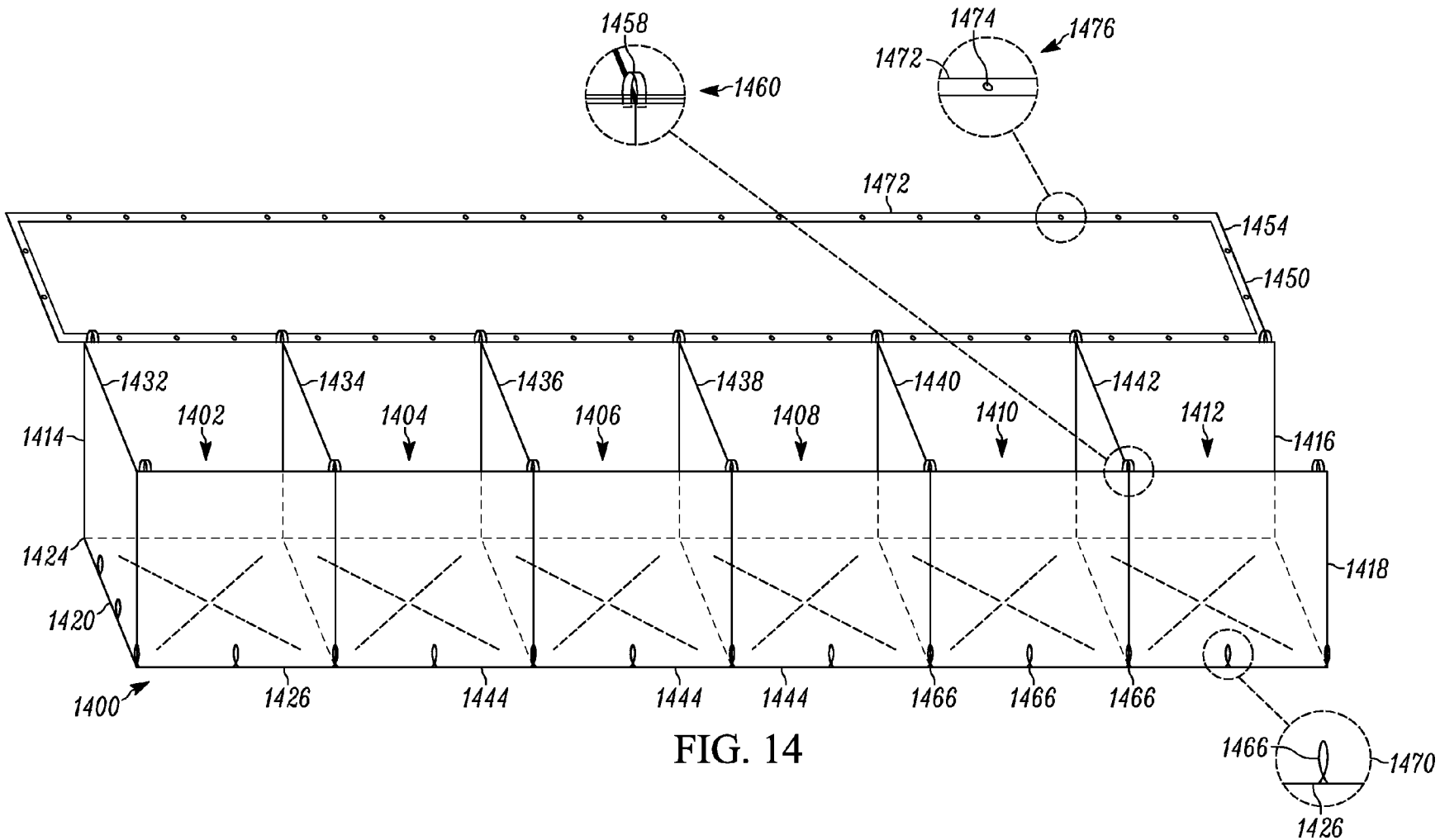
FIG. 14 is a schematic side perspective view of a further, alternate exemplary embodiment of a flood protection bag having an attached top, including several enlarged detail views of exemplary embodiments of several subportions of the bag.

Further, the flood protection bag 1400 has a series of internal walls 1432, 1434, 1436, 1438, 1440 and 1442, respectively, which correspond to the internal walls 132, 134, 136, 138, 140, and 142, respectively. Also, the flood protection bag 1400 includes multiple stabilizing loops 1458, one of which is shown in an enlarged detail view 1460 in FIG. 14, and which respectively correspond to and are identical (or substantially similar) to the stabilizing loops 158 of FIG. 1. Also, as shown in FIG. 14 and also more fully in FIG. 15, the bottom wall 1420 includes bottom sections 1444 corresponding to the bottom sections 208 of FIG. 2. As particularly illustrated by an enlarged detail view 1445, each of the bottom sections 144 is scored in a manner such that there are X-shaped cuts 1446 extending inwardly to respective center points 1447 of each of the X-shaped cuts (the centers of the X's) from respective bottom corners 1448 of the respective bag chambers 1402, 1404, 1406, 1408, 1410, 1412.

Figure 15:
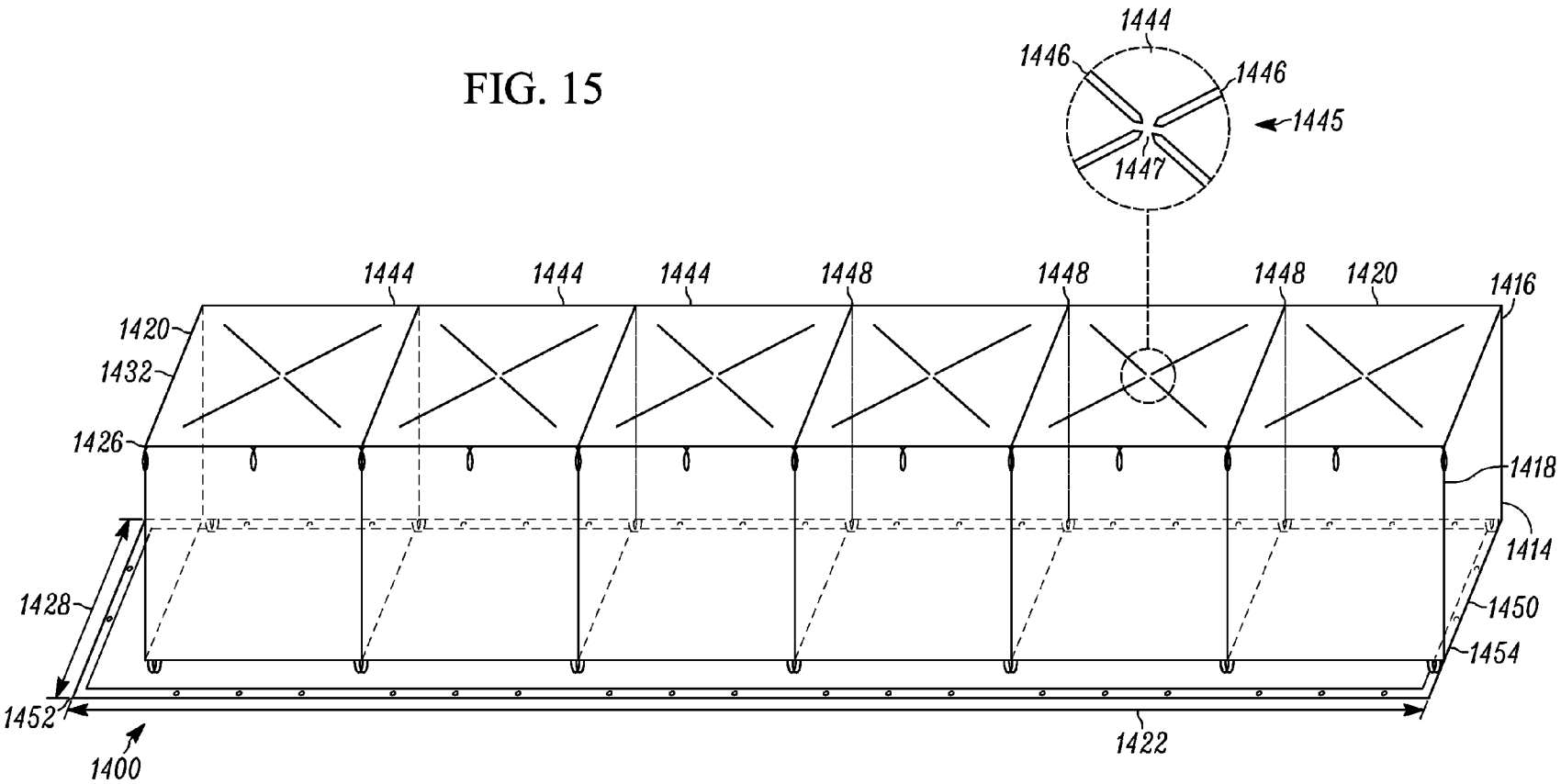
FIG. 15 is a schematic bottom perspective view of the flood protection bag of FIG. 14, including an enlarged detail view of an exemplary embodiment of a feature of the bottom of the bag.

In contrast to the embodiment of FIGS. 1-4, however, the flood protection bag 1400 is not separate from a bag top portion but rather includes a bag top portion 1450 (or "overtopping feature") that is integrally formed with or at least permanently or substantially permanently attached to (e.g., by way of stitching/seams/ties) the top edge of the first side wall 1416. As shown particularly in FIG. 15, the bag top portion 1450 in the present embodiment has a length along a longitudinal axis 1422 that is longer than a length of the main body of that flood protection bag (that is, longer than a length of the bag along the bottom edges 1426, 1428. Consequently, the bag top portion 1450 includes a lip section 1452 extending past the internal wall 1432 as shown. Also, the bag top portion 1450 has a width along a width axis 1428 of the flood protection bag 1400 that is wider than the width of the main body of that flood protection bag (that is, wider than a width of the bottom wall 1420 of the flood protection bag corresponding to the bottom wall 120 of FIG. 1 as measured along the width axis 1428). Consequently, the bag top portion 1450 also includes an additional lip section 1454 that extends past the top edge of the second side wall 1414 when bag top portion 1450 is extended so as to extend horizontally parallel to the bottom wall 1420 as shown in FIG. 15.

Due to the integral formation of the bag top portion 1450 with respect to the first side wall 1416 (or its connection to that side wall), the bag top portion 1450 need not be attached to the first side wall 1416 by way of cover strap loops 166 such as those of FIG. 1 that are arranged along that first side wall. However, to more completely secure the bag top portion 1450 to the remainder of the flood protection bag 1400 so as to operate as a cover over the internal bag chambers 1402, 1404, 1406, 1408, 1410, and 1412, in the present embodiment the flood protection bag 1400 includes a mechanism by which the additional lip section 1454 can be attached to the second side wall 1418. More particularly in this regard, in the present embodiment the flood protection bag 1440 includes cover strap loops 1466 positioned along the second bottom edge 1426, one of which is shown in an enlarged detail view 1470. Further, to secure the bag top portion 1450 and particularly the additional lip section 1454 thereof to the cover strap loops 1466, the bag top portion 1450 along an outer longitudinal edge 1472 thereof includes multiple loop holes 1474, one of which is shown in an enlarged detail view 1476. One method of securement includes respective ones of the cover strap loops 1466 being inserted through respective ones of the loop holes 1474 and, after insertion, tied off (e.g., two of the neighboring cover strap loops 1466 can be tied to one another, of after passing through a given one of the loop holes, the respective cover strap loop can be tied into a knot at its end so as to preclude its passing back out through the loop hole) so as to maintain the connection of the cover strap loops to the additional lip section 1454. Either the cover strap loops 1466, or the bag top portion 1450 itself, or both, can be made of elastic or stretchable material that allows for the cover strap loops to reach and be attached to the loop holes 1474.

In other embodiments, other mechanisms can be employed to connect and retain the additional lip section 1454 in relation to the cover strap loops. For example, in other embodiments, the additional lip section 1454 can employ cover hooks identical (or substantially similar) to the cover hooks 412 as discussed above in relation to FIG. 4. Further it should be appreciated that, although in the present embodiment the cover strap loops 1466 are positioned along the second bottom edge 1426 along the bottom wall 1420, in other embodiments the cover strap loops can be positioned at other locations including, for example, a location approximately one third of the distance from the top edge of the second side wall 1418 to the second bottom edge (e.g., at the location of the cover strap loops 166 shown along the second side wall 118 in FIG. 1), or at other locations. Also for example, in other embodiments, the bag top portion 1450 can be secured relative to the second side wall 1418 (and/or otherwise to the remainder of the flood protection bag 1400) by way of any of a variety of other mechanisms. It should also be noted that, in at least some implementations of the flood protection bag 1400 with the bag top portion 1450 in which the bag top portion 1450 is integrally formed with or at least permanently or substantially permanently attached to the top edge of the first side wall 1416 but only fastened by way of fastening devices or the like with respect to the second side wall 1418, it can be desirable when implementing the bag in flood conditions that the flood protection bag be orientated so that the first side wall 1416 is on the windward side and the second side wall 1418 is on the leeward side, such that the more continuous (and perhaps more robust) link between the bag top portion and the flood protection is on the windward (rather than leeward) side.

The embodiments described above as well as other embodiments encompassed herein can be modified to include or otherwise entail a variety of other additional features, in addition to or instead of one or more of the features described above. For example, in some embodiments, a combination flood protection bag is formed from an assembly of bags, where two or more bags are connected with the use of a connector chamber will create a sealed link to prevent leakage. Also, in some embodiments, the use of a filling frame to fill chambers with sand will allow for a uniform filling. Also, in some embodiments, the flood protection bag 100 is a bag that is over 5 feet in thickness. Such a large bag filled with sand will create a better barrier to flooding waters than bags of a lesser thickness. The three types of types of filling apparatus discussed above are only intended to be examples of filling apparatuses. While the filling frame 602 discussed above is envisioned as being for light duty use (to that end, the filling frame 602 can be made of heavy duty plastic so as to allow for lifting by personnel to change filling positions), a medium duty or heavy duty of such filling fame is also possible. Also, other medium duty and heavy duty filling apparatuses are possible, in addition to the tubular steel, towable carts/trailers discussed above. Notwithstanding the above description, the present disclosure is also intended encompass a variety of other bags, barriers, and the like, even if such items are not particularly or exclusively intended for use in flood protection. The present disclosure can encompass indeed a variety of bags and bag-type structures that form barriers, walls, and/or other protective mechanisms that provide protection in a variety of circumstances from a variety of types liquids in addition to water, as well as protection in further circumstances such as in battle or wartime (e.g., from bullets or shrapnel).

At least some of the embodiments described above as well as other embodiments encompassed herein can have one or more of the following features, and include one or more of the following advantages. For example, in some embodiments, the flood protection bag is capable of rapid deployment (e.g., in 100', 200', 300' sections), which can save on manpower and on installation time. Also, in some embodiments, the flood protection bag has bag chamber dimensions less than, substantially less than, substantially equal to, equal to, or greater than 5 feet by 5 feet by 5 feet in size (for example, in another embodiment the dimensions can be 4 feet by 4 feet by 4 feet, or substantially 4 feet by 4 feet by 4 feet). At least some such dimensions (e.g., 5 feet by 5 feet by 5 feet) allow the overall flood barrier to stand tall to repel water. Further, in some embodiments, the flood protection bag is capable of being filled with sand, mud, or other materials reflecting the expertise of the state, province or other entity administering flood relief. Further, use of an external filling frame that is distinct from the flood protection bag itself allows for lower product cost (particularly in terms of the bag itself). Additionally, the use of interconnected bag chambers allows for easy/low time repair. The providing of multiple bag chambers adjacent to one another further facilitates rapid loading/filling of the bag chambers with reduced spillage outside of the bag, while providing interconnecting stability.

Additionally, at least some of the embodiments facilitate simultaneous multiple section filling, which makes for easy payloader filling and low spillage (or low amounts of undesired spillage). Further, at least some of the embodiments employ strong/tough, long life Geo Textile Fabric for use in constructing the flood protection bag. Such fabric allows for increased abrasion resistance. Also, at least some embodiments have bag chambers within a flood protection bag that are large, for example, bag chambers that are 125 Cubic Ft. in volume and hold substantially 12,500 lb. or more of filling material. This allows for a flood protection bag with a heavy base that provides stability against waves and large water volumes, as well as resistance against floating debris. In other embodiments, the bag chambers can have different dimensions that result in a different volume, and also in some embodiments the length, width, and depth dimensions of bag chambers need not all be identical (for example, the length could be greater or less than the width). Further, in other embodiments, the bag chambers can be configured to hold other amounts of filling materials such as, for example, substantially 10,000 lb or more of filling material.

Additionally, the use of a flexible fabric material for the bag allows the bag to follow the contours of the ground on which the bag sits, further aiding in stability of the bag and flood barrier/wall formed by the bag. Also, in some embodiments, the flood protection bags are stackable. Even when two flood protection bags are stacked two (one on top of another, vertically), the resulting combination bag/flood barrier/wall is stable at twice the height of a single one of the bags. Further, the flood protection bags have seamless connectability, such that breaching at connection points is minimized or avoided completely.

Also, it should be appreciated that the present disclosure is intended to encompass a variety of different embodiments in which bag tops are coupled permanently, semi-permanently, or temporarily, by way of a variety of coupling or attachment mechanisms to main flood bag structures having bag chambers (including some embodiments where bag tops are integral with and form part of the main flood bag structures). In some embodiments, for example, the flood protection bags have connection structures provided along exterior surfaces along one or both of first and second sides (along one or both of the bag side walls), where the connection structures are configured to receive fastening mechanisms of a bag top that can be thereby fastened to the containment structure. Also, in some embodiments, flood protection bags have connection structures that are provided along both of the first and second sides, and the bag top is a structure capable of being fully separated from the container structure. Further, in some embodiments, the flood protection bags have connection structures that are positioned either at locations midway between uppermost and lowermost edges of the first and second sides of the bags, or at locations along the lowermost edges of the first and second sides. Additionally, in some embodiments, the flood protection bags have connection structures that are provided along at least one of the first and second sides, and the bag top is a structure that is either integrally formed with the container structure along an edge of the container structure or attached to the container structure along an edge of the container structure by an attachment mechanism other than the connection structures and fastening mechanisms (e.g., where the bag top is sewn to the container structure).

Indeed, depending upon the embodiment, the flood protection bag can be accompanied by or include a bag top portion where the bag and bag top portion are fastened, attached, or integrated in any of a number of manners, including (i) by coupling fastening devices of the bag top portion to additional complementary fastening devices provided along at least one side of the bag structure (ii) by integrally forming the bag top portion with the bag. It is also possible, when multiple bag structures are assembled with one another, to attach a bag top portion to one or more of the bag structures by way of fastening devices that are configured to engage complementary fastening devices formed along the one or more of the first and second bag structures.

It should be evident from the above discussion that, depending upon the embodiment or circumstance, a flood protection bag can refer to a structure that is distinct (and, in at least some embodiments, separate) from any bag top portion or, alternatively, can encompass both the main bag structure as well as any bag top portion. Thus, as already discussed above, the flood protection bag 100 (or other flood protection bags such as the additional flood protection bag 300 or combination flood protection bag 302) has been described as being a distinct structure separate from any bag top portion (or other cover portion) attachable thereto (such as that of FIG. 4), with the overall combination structure encompassing both a flood protection bag and bag top portion when assembled constituting a flood protection bag assembly. Nevertheless, this manner of referring to these structures is merely for convenience, and it is equally possible to refer to these structures in other manners. For example, as with the description pertaining to FIGS. 14-15, the combination of a flood protection bag identical (or substantially similar) to the flood protection bag 100 and a bag top portion such as the bag fop portion 1450 can itself be referred to as a flood protection bag such as the flood protection bag 1400. (Indeed, the structure corresponding to the flood protection bag 100 and the bag top portion 400 in combination can also be referred to as a flood protection bag.) Also, notwithstanding the use of the term "bag" herein, the structures described herein and/or variations thereof can also be referred to as, or be considered to constitute, containers, containment structures, or other types of structures.

Also, although certain filling frame supports are disclosed in detail herein, the present disclosure is also intended to encompass a variety of other embodiments of filling frame supports or other support mechanisms or structures that enable or facilitate filling of flood protection bag(s) such as those disclosed or encompassed herein. Also, the present disclosure is intended to encompass not only a variety of flood protection bag(s) and filling frame supports (or other support mechanisms or structures), but also use of a variety of devices that perform the filling of such bag(s) supported by such filling frame supports (or other support mechanism or structures), by lifting, depositing, or otherwise moving any of a variety of types of materials including but not limited to sand or soil.

Further, although in the discussion above there are stabilizing loops 158 or 1458 at or proximate to each upper corner of each of the internal bag chambers 102, 104, 106, 108, 110, 112, 1402, 1404, 1406, 1408, 1410, 1412, this need not be the case in all embodiments. For example, in some alternate embodiments, occasionally one or more upper corners do not include any stabilizing loop, or only a majority of ail upper corners of a given flood protection bag include stabilizing loops by which those upper corners can be supported. Or, in some alternate embodiments, one or more stabilizing loops can be provided in between respective pairs of neighboring upper corners and each of such stabilizing loops can be used to provide support that is substantially sufficient to replace the support that would have otherwise been achieved by utilizing stabilizing loops at or proximate to each of the neighboring upper corners. Also, in some cases, not all stabilizing loops must be engaged during the filling process; for example, in some cases, certain ones of the internal bag chambers are not filled or only partly-filled such that not all of the stabilizing loops at the upper corners of those internal bag chambers need be supported. Further, notwithstanding the disclosure herein of loops and hooks being used as fastening devices, in other embodiments other types of fastening devices can be employed including, for example, snaps.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

We claim:

1. A flood protection system comprising:

a containment structure having a first side, a second side, and a bottom extending between the first and second sides;

at least one internal divider portion, wherein each internal divider portion extends between the first side and the second side and further to the bottom, wherein the containment structure and the at least one internal divider portion at least partly define a series of container regions positioned one by one along the containment structure, and wherein each of the first side, the second side, and the bottom of the containment structure extends in a continuous, seamless manner from alongside a first of the container regions to a second of the container regions; and a plurality of fastening devices respectively positioned at or proximate to respective upper corners of at least some of the container regions of the series of container regions, wherein there is a respective one of the fastening devices positioned at or proximate to each of the upper corners of each of the first and second container regions, wherein the fastening devices are configured to allow all of the upper corners associated with each of the first and second container regions to be supported by at least one frame portion during at least one filling of each of the first and second container regions, wherein each of the at least one frame portion includes a respective plurality of legs at least indirectly linked with one another and at least one respective spring connection member, and wherein, at least temporarily, fastening mechanisms on the at least one frame portion engage at least some of the fastening devices so as to place tension upon each of the upper corners associated with a given one of the container regions, and wherein each of the legs includes a respective one of the at least one respective spring connection member positioned between a respective upper portion of the respective leg and a respective lower portion of the respective leg, so as to allow for compressing of the respective upper portion relative to the respective lower portion.

2. The flood protection system of claim 1, wherein there is a respective one of the fastening devices positioned at or proximate to each of the upper corners of each of the container regions of the series of container regions including the first and second container regions.

3. The flood protection system of claim 2, wherein a first corner of the first container region is also a first corner of an adjacent one of the container regions, and wherein the fastening device associated with the first corner of the first container region is also the fastening device associated with the first corner of the adjacent one of the container regions.

4. The flood protection system of claim 1, wherein the containment structure and at least one internal divider portion are made of polypropylene or polyethylene.

5. The flood protection system of claim 1, wherein the at least one internal divider portion includes a plurality of divider portions.

6. The flood protection system of claim 5, wherein each of the divider portions is attached to the first side, the second side, and the bottom, and wherein the plurality of divider portions assist in defining a plurality of the container regions.

7. The flood protection system of claim 6, wherein each of the divider portions is attached to the first side, the second side, and the bottom by way of at least one stitch.

8. The flood protection system of claim 1, wherein each of the container regions includes a respective set of at least three surfaces formed by respective portions of the first and second sides and a respective one of the at least one internal divider portion, and additionally includes a respective further surface formed by a respective section of the bottom.

9. The flood protection system of claim 8, wherein each of the respective further surfaces of the respective container regions includes a respective bottom intermediate region and respective bottom corners, and wherein the respective bottom intermediate region of each of the further surfaces is configured to sag lower than the respective bottom corners of the respective further surface.

10. The flood protection system of claim 9, wherein each of the respective further surfaces of the respective container regions includes respective X-shaped cuts, and wherein each of the X-shaped cuts of each of the respective further surfaces extends all or substantially all of a respective distance between a respective one of the bottom corners of the respective further surface and a respective opposing one of the bottom corners of the respective further surface.

11. The flood protection system of claim 1, wherein a first of the at least one internal divider portion is positioned at a first end of the containment structure so as to connect first and second end edges of the first and second sides, respectively, a second end of the containment structure lacks any one of the at least one internal divider portion, and thus third and fourth end edges of the first and second sides, respectively, are unconnected by any one of the at least one internal divider portion.

12. The flood protection system of claim 11, wherein the first container region at the first end is bounded by four side surfaces formed by respective portions of the first and second sides, the first internal divider portion, and a second of the at least one internal divider portion, and the second container region at the second end is bounded only by three side surfaces formed by respective portions of the first and second sides and either the second internal divider portion or another of the at least one internal divider portion.

13. The flood protection system of claim 12, wherein the containment structure, the at least one internal divider portion, and the plurality of fasteners form a first bag structure having the series of container regions, each of which is a respective bag chamber or bag chamber portion, and further comprising a second bag structure substantially identical in structure to the first bag structure.

14. The flood protection system of claim 13, wherein the first and second bag structures are integrated with one another so as to form a combination bag structure by positioning a first end section of the second bag structure within the second container region of the first bag structure, such that respective side portions of the first and second sides substantially overlap respective side portions of third and fourth sides of the second bag structure and also a first bottom portion of the first bag structure substantially overlaps an another bottom portion of the second bag structure.

15. The flood protection system of claim 13, wherein the first and second bag structures are integrated with one another so as to form a combination bag structure by positioning the first container region of the first bag structure into a second end section of the second bag structure, such that respective side portions of the third and fourth sides of the second bag structure substantially overlap respective side portions of the first and second sides of the first bag structure and also a first bottom portion of the second bag structure substantially overlaps another bottom portion of the first container region of the first bag structure, whereby the first internal divider portion at least in part serves to divide the first container region from an adjacent container region formed in the second bag structure.

16. The flood protection system of claim 1, wherein each of the container regions has a respective length dimension, a respective width dimension, and a respective depth dimension, and each of the respective length, width, and depth dimensions has a respective extent that is substantially in orange of 4 feet to 5 feet, and the containment structure has a length substantially equaling or greater than 100 feet.

17. The flood protection system of claim 16, wherein each of the container regions that is bounded by respective portions of the first side, second side, and bottom, and additionally by respective first and second ones of the at least one internal divider portion, forms a respective bag chamber.

18. The flood protection system of claim 1, wherein connection structures are provided along exterior surfaces along each of the first and second sides, the connection structures configured to receive fastening mechanisms of a bag top that can be thereby fastened to the containment structure.

19. The flood protection system of claim 18, wherein each of the bag top and a bag structure including the containment structure and the at least one internal divider portion can be folded up into a more compact form, wherein the bag top and bag structure together form an overall bag assembly.

20. The flood protection system of claim 1, wherein each of at least one frame portion additionally includes respective first and second bridge members respectively linking the first and second legs and third and fourth leas of the respective frame portion, respectively, and respective additional connection members at least indirectly linking the first and third legs and second and fourth legs of the respective frame portion, respectively.

21. A method of implementing a flood protection bag structure, the method comprising:

a) providing the bag structure;

b) attaching at least four primary fastening devices of the bag structure positioned respectively at corners of a single bag chamber of a series of bag chambers of the bag structure to at least tour complementary fastening devices attached to a frame structure;

c) causing the single bag chamber to be substantially tilled with a filling material;

d) applying downward pressure to at least one portion of the frame structure so as to reduce tension between the at least four primary fastening devices and the at least four complementary fastening devices, thus allowing for the primary fastening devices and complementary fastening devices to be disengaged; and e) moving the frame structure so that the frame structure is positioned above a different one of the bag chambers of the series of bag chambers; and repeating (b) to (d) at least once.

22. The method of claim 21, further comprising, prior to (a), unfolding the bag structure.

23. The method of claim 21, further comprising, subsequent to (e), securing a bag top portion with respect to the bag structure, wherein the bag top portion is capable of being fully separated from the bag structure, and further comprising unfolding the bag top portion prior to the securing of the bag top portion.

24. A flood protection system comprising:

a plurality of bag structures, wherein each of the bag structures includes:

respective first and second sides;

a respective bottom extending between the respective first and second sides; and a respective plurality of internal divider portions extending between the respective first and second sides and to the respective bottom of the respective bag structure so as to define a respective series of bag chambers within the respective bag structure, wherein a first of the bag structures includes, at a first end thereof, a bag chamber portion bounded by the respective first side, second side, and bottom of the first bag structure and further bounded by a first of the respective internal divider portions of the first bag structure that is positioned inwardly of the first end such that the ba2 chamber portion is open-ended at the first end of the first bag structure, wherein a second of the bag structures includes, at a first end thereof, a bag chamber bounded by the respective first side, second side, and bottom of the second bag structure and further bounded by two of the respective internal divider portions, and wherein the second bag structure is positioned so that the first end and the bag chamber at the first end are positioned into the bag chamber portion of the first bag structure such that the first internal divider portion of the first bag structure is substantially adjacent to a first of the two internal divider portions of the second bag structure.

25. The flood protection system of claim 24, further comprising a plurality of fastening mechanisms provided along or proximate upper corners of each of the bag chambers of at least one of the first and second bag structures, the fastening mechanisms being configured to allow coupling of the at least one bag structure to a support structure employed to support the at least one bag structure when the bag chambers of the at least one bag structure are being filled.

* * * * *

UNITED STATES PATENT AND TRADEMARK OFFICE

CERTIFICATE OF CORRECTION

PATENT NO. : 8,721,221 B2
APPLICATION NO. : 13/310494
DATED : May 13, 2014
INVENTOR(S) : Edward John Cavenagh, Gregg Martin and Selamawit Tedesse Desta It is certified that error appears in the above-identified patent and that said Letters Patent is hereby corrected as shown below:

In the Claims

Claim No. 16

Column 27, line 22, replace “orange” with --a range--

Claim No. 21

Column 27, line 56, replace “tilled” with --filled--

Signed and Sealed this
Twenty-ninth Day of July, 2014

Michelle K. Lee

Michelle K. Lee
*Deputy Director of the United States Patent and Trademark Office*